US011757193B2

(12) United States Patent
Jung et al.

(10) Patent No.: US 11,757,193 B2
(45) Date of Patent: Sep. 12, 2023

(54) WIDEBAND ANTENNA DISPOSED IN VEHICLE

(71) Applicant: LG ELECTRONICS INC., Seoul (KR)

(72) Inventors: Kangjae Jung, Seoul (KR); Kukheon Choi, Seoul (KR); Byeongyong Park, Seoul (KR); Uisheon Kim, Seoul (KR); Ilnam Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 83 days.

(21) Appl. No.: 17/597,835

(22) PCT Filed: Aug. 25, 2021

(86) PCT No.: PCT/KR2021/011332
§ 371 (c)(1),
(2) Date: Jan. 25, 2022

(87) PCT Pub. No.: WO2022/092514
PCT Pub. Date: May 5, 2022

(65) Prior Publication Data

US 2022/0320736 A1 Oct. 6, 2022

(30) Foreign Application Priority Data

Oct. 29, 2020 (KR) ..... 10-2020-0142468

(51) Int. Cl.
*H01Q 9/04* (2006.01)
*H01Q 1/12* (2006.01)
(Continued)

(52) U.S. Cl.
CPC ..... *H01Q 9/045* (2013.01); *H01Q 1/1271* (2013.01); *H01Q 1/32* (2013.01); *H01Q 1/48* (2013.01)

(58) Field of Classification Search
CPC ..... H01Q 1/1271; H01Q 1/32; H01Q 1/3275; H01Q 1/38–48; H01Q 9/045; H01Q 9/0407
See application file for complete search history.

(56) References Cited

U.S. PATENT DOCUMENTS 7,471,248 B2 * 12/2008 Popugaev ..... H01Q 5/364 343/700 MS
9,865,928 B2 * 1/2018 Sudo ..... H01Q 1/38
(Continued)

FOREIGN PATENT DOCUMENTS

KR 1020050120442 12/2005
KR 1020100022759 3/2010

OTHER PUBLICATIONS

PCT International Application No. PCT/KR2021/011332, International Search Report dated Dec. 14, 2021, 8 pages.
(Continued)

*Primary Examiner* — Hasan Islam
(74) *Attorney, Agent, or Firm* — LEE, HONG, DEGERMAN, KANG & WAIMEY PC

(57) ABSTRACT

An antenna assembly according to an implementation may include a dielectric substrate, a first patch having a first slot formed at an inner region of a first conductive pattern disposed on the dielectric substrate and configured to radiate a signal in a first band through the first conductive pattern, and a second patch having a second slot formed at an inner region of a second conductive pattern disposed at an inner region of the first slot and configured to radiate a signal in a second band and a third band through the second conductive pattern.

20 Claims, 27 Drawing Sheets

(51) Int. Cl.
*H01Q 1/32* (2006.01)
*H01Q 1/48* (2006.01)

(56) References Cited

U.S. PATENT DOCUMENTS

| | | | | |
|---|---|---|---|---|
| 2011/0001682 | A1* | 1/2011 | Rao | H01Q 21/065 343/893 |
| 2017/0093042 | A1 | 3/2017 | McMichael et al. | |
| 2019/0020110 | A1* | 1/2019 | Paulotto | H01Q 5/20 |

OTHER PUBLICATIONS

Zhu et al., "Compact CPW UWB Diversity Slot Antenna with Dual Band-Notched Characteristics," Microwave and Optical Technology Letters, vol. 58, No. 4, Apr. 2016, 6 pages.
Saad et al., "Conceptual design of a compact four-element Uwb Mimo slot antenna array," IET Microwaves, Antennas & Propagation, vol. 13, Issue 2, pp. 208-215, Feb. 2018, 8 pages.

* cited by examiner (a) 1.71 GHz (b) 3.5 GHz 1.7GHz

PORT 1

(a)

PORT 2

(b)

2.5GHz

PORT 1

(a)

PORT 2

(b)

3.4GHz

PORT 1

(a)

PORT 2

(b)

6GHz

PORT 1

(a)

PORT 2

(b)

(a)

(b)

WIDEBAND ANTENNA DISPOSED IN VEHICLE

CROSS-REFERENCE TO RELATED APPLICATIONS

This application is the National Stage filing under 35 U.S.C. 371 of International Application No. PCT/KR2021/011332, filed on Aug. 25, 2021, which also claims the benefit of earlier filing date of and right of priority to Korea Patent Application No. 10-2020-0142468 filed on Oct. 29, 2020, the contents of which are all incorporated by reference herein in its entirety.

TECHNICAL FIELD

This specification relates to a wideband antenna disposed in a vehicle. One particular implementation relates to an antenna system having a wideband antenna that is made of a transparent material to operate in various communication systems, and to a vehicle having the same.

BACKGROUND ART

A vehicle may perform wireless communication services with other vehicles or nearby objects, infrastructures, or a base station. In this regard, various communication services can be provided through a wireless communication system to which an LTE communication technology or a 5G communication technology is applied. some of LTE frequency bands may be allocated to provide 5G communication services.

On the other hand, there is a problem in that a vehicle body and a vehicle roof are formed of a metallic material to block radio waves. Accordingly, a separate antenna structure may be disposed on a top of the vehicle body or the vehicle roof. Or, when the antenna structure is disposed on a bottom of the vehicle body or roof, a portion of the vehicle body or roof corresponding to a region where the antenna structure is disposed may be formed of a non-metallic material.

However, in terms of design, the vehicle body or roof needs to be integrally formed. In this case, the exterior of the vehicle body or roof may be formed of a metallic material. This may cause antenna efficiency to be drastically lowered due to the vehicle body or roof.

In order to increase a communication capacity without a change in the exterior design of the vehicle, a transparent antenna may be disposed on glass corresponding to a window of the vehicle. However, antenna radiation efficiency and impedance bandwidth characteristics may be deteriorated due to an electrical loss of the transparent antenna.

Meanwhile, a structure in which an antenna layer with an antenna pattern and a ground layer with a ground pattern are disposed on different planes is generally used. In particular, when operating as a wideband antenna, it is necessary to increase a thickness between the antenna layer and the ground layer. However, for a transparent antenna for a vehicle, an antenna region and a ground region need to be disposed on the same layer. Such an antenna in which the antenna pattern and the ground pattern are disposed on the same layer is difficult to operate as a wideband antenna.

DISCLOSURE OF INVENTION

Technical Problem

The present disclosure is directed to solving the aforementioned problems and other drawbacks. The prevent disclosure also describes an antenna made of a transparent material that is capable of operating in a wideband range while providing LTE and 5G communication services.

The prevent disclosure further describes a transparent antenna made of a transparent material capable of operating in a wideband range by combining a patch antenna structure of various shapes with slots.

The present disclosure further describes an antenna structure made of a transparent material capable of obtaining improved antenna efficiency while operating in a wideband range.

The present disclosure further describes a structure in which a transparent antenna having improved antenna efficiency while operating in a wideband range can be disposed at various positions on a window of a vehicle.

The present disclosure further describes improvement of communication performance by arranging a plurality of transparent antennas on a display of an electronic device or glass of a vehicle.

Technical Solution

According to those and other advantages of the subject matter described in this application, an antenna assembly may include a dielectric substrate, a first patch having a first slot formed at an inner region of a first conductive pattern disposed on the dielectric substrate and configured to radiate a signal in a first band through the first conductive pattern, and a second patch having a second slot formed at an inner region of a second conductive pattern disposed at an inner region of the first slot and configured to radiate a signal in a second band and a third band through the second conductive pattern.

In some implementations, the antenna assembly may further include a first feeding line disposed at a first region of the first slot between an inside of the first patch and an outside of the second patch, a second feeding line disposed at a second region of the first slot between the inside of the first patch and the outside of the second patch, the second region corresponding to a position where the second feeding line is orthogonal to the first feeding line, and a connection line configured to connect the first path and the second patch between the first feeding line and the second feeding line.

In some implementations, the first feeding line and the second feeding line may configure a first Coplanar Wavelength (CPW) feeding structure and a second CPW feeding structure in which ground patterns are disposed at both sides of a signal line. The signal line may include therein a first signal line and a second signal line spaced apart from each other by a dielectric region, and the first signal line and the second signal line may extend along the inside of the first patch and the outside of the second patch.

In some implementations, the first patch may be integrally formed with the ground patterns of the first CPW feeding structure and the second CPW feeding structure. The second patch may be connected to the first patch by the connection line to be integrally formed with the ground patterns of the first CPW feeding structure and the second CPW feeding structure.

In some implementations, the second slot formed inside the second patch may be a circular slot, and the circular slot may be offset from a center of the second patch to be disposed adjacent to the connection line.

In some implementations, the first patch may be formed in a square shape, the second patch may be formed in a circular shape, and the first slot and the second slot may be formed in a circular shape.

In some implementations, the first patch may be formed in a circular shape, the second patch may be formed in a circular shape, and the first slot and the second slot may be formed in a circular shape.

In some implementations, the first patch may be formed in a square shape, the second patch may be formed in a square shape, the first slot may be formed in a square shape, and the second slot may be formed in a circular shape.

In some implementations, the first patch may be formed in a polygonal shape, the second patch may be formed in a polygonal shape, the first slot may be formed in a polygonal shape, and the second slot may be formed in a circular shape.

In some implementations, radiation may be carried out in the second band through the patch having the square shape disposed in the first slot inside the patch having the square shape. Radiation may be carried out in the third band through the first slot between the patch having the square shape and the patch having the circular shape. The second band may be a band higher than the first band and the third band may be a band higher than the second band.

In some implementations, the first feeding line may include first conductive patterns disposed at both sides of the dielectric region, and first coupling lines extending from end portions of the first conductive patterns to both sides along the first slot to couple a first signal to the first patch or the second patch. An end portion of one of the first coupling lines may be spaced apart from the connection line by a predetermined distance.

In some implementations, the second feeding line may include second conductive patterns disposed at both sides of the dielectric region, and second coupling lines extending from end portions of the second conductive patterns to both sides along the first slot having the circular shape to couple a second signal to the first patch or the second patch. An end portion of one of the second coupling lines may be spaced apart from the connection line by a predetermined distance.

In some implementations, the first coupling lines may include a third signal line disposed adjacent to the connection line and a fourth signal line disposed away from the connection line. The second coupling lines may include a third signal line disposed adjacent to the connection line and a fourth signal line disposed away from the connection line.

In some implementations, the antenna assembly may operate as a first antenna and a second antenna in the third band by the first slot between the fourth signal line of the first coupling lines and the fourth signal line of the second coupling lines.

In some implementations, first ground patterns may be disposed adjacent to the first conductive patterns, and second ground patterns may be disposed adjacent to the second conductive patterns. Gaps between the first ground patterns and the first conductive patterns may increase from a first gap to a second gap as being adjacent to the first slot having a circular shape.

In some implementations, the antenna assembly may operate as a first antenna having a first polarization by a first radio signal applied from the first feeding line. The antenna assembly may operate as a second antenna having a second polarization orthogonal to the first polarization by a second radio signal applied from the second feeding line.

In some implementations, the first conductive pattern of the first patch and the second conductive pattern of the second patch may be configured as metal mesh patterns in which a plurality of grids are electrically connected, so as to implement the antenna assembly as a transparent antenna.

According to those and other advantages of the subject matter described in this application, an antenna system for a vehicle that includes a conductive vehicle body operating as an electrical ground may include glass constituting a window of the vehicle, a dielectric substrate attached to the glass and having conductive patterns in a form of a mesh grid, a first patch having a first slot formed at an inner region of a first conductive pattern on the dielectric substrate and configured to radiate a signal in a first band through the first conductive pattern, a second patch having a second slot formed at an inner region of a second conductive pattern disposed at an inner region of the first slot and configured to radiate a signal in a second band and a third band through the second conductive pattern, the first patch and the second patch configuring transparent antenna elements.

In some implementations, the antenna system for the vehicle may further include a first feeding line disposed at a first feeding region of the first slot between an inside of the first patch and an outside of the second patch, a second feeding line disposed at a second region of the first slot between the inside of the first patch and the outside of the second patch, the second region corresponding to a position where the second feeding line is orthogonal to the first feeding line, and a connection line configured to connect the first path and the second patch between the first feeding line and the second feeding line.

In some implementations, the first feeding line and the second feeding line may configure a first Coplanar Wavelength (CPW) feeding structure and a second CPW feeding structure in which ground patterns are disposed at both sides of a signal line. Partial regions of the first CPW feeding structure and the second CPW feeding structure may be implemented in a transparent region of the window of the vehicle, and remaining regions may be implemented in a non-transparent region of the window of the vehicle. The antenna system may operate as a first antenna and a second antenna by the first feeding line and the second feeding line.

In some implementations, the antenna system for the vehicle may further include a transceiver circuit operably coupled to the first antenna through the first feeding line and operably coupled to the second antenna through the second feeding line, and a processor operably coupled to the transceiver circuit and configured to control the transceiver circuit.

In some implementations, the transparent antenna elements may include a first antenna element and a second antenna element spaced apart from each other by a predetermined distance. The first antenna element may operate as a first antenna having a first polarization by a first radio signal applied from the first feeding line, and as a second antenna having a second polarization different from the first polarization by a second radio signal applied from the second feeding line. The second antenna element may operate as a third antenna having the first polarization by a third radio signal applied from a third feeding line, and as a fourth antenna having the second polarization by a fourth radio signal applied from a fourth feeding line.

In some implementations, the processor may control the transceiver circuit to perform 4×4 MIMO through the first antenna element and the second antenna element.

In some implementations, the processor may control the transceiver circuit to apply a first radio signal and a second radio signal of different bands to the first antenna and the second antenna, to perform Carrier Aggregation (CA) or Dual Connectivity (DC) through the first antenna and the second antenna.

Advantageous Effects of Invention

Technical effects of a wideband antenna disposed in a vehicle will be described as follows.

In some implementations, an antenna made of a transparent material that operates in a wideband range and can provide LTE and 5G communication services can be provided by forming a first slot inside a first patch and a second slot in a second patch.

In some implementations, a transparent antenna made of a transparent material that can operate in a wideband range can be provided by combining a patch antenna structure of various shapes such as a square patch, a polygonal patch, or a circular patch with slots of various shapes.

In some implementations, an antenna structure of a transparent material, which can obtain improved antenna efficiency and transparency while operating in a wideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on a display of an electronic device or glass of a vehicle.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

MODE FOR THE INVENTION

Description will now be given in detail according to exemplary implementations disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure may not be limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

An antenna system described herein may be mounted on a vehicle. Configurations and operations according to implementations may also be applied to a communication system, namely, antenna system mounted on a vehicle. In this regard, the antenna system mounted on the vehicle may include a plurality of antennas, and a transceiver circuit and a processor for controlling the plurality of antennas.

Figure 1A:
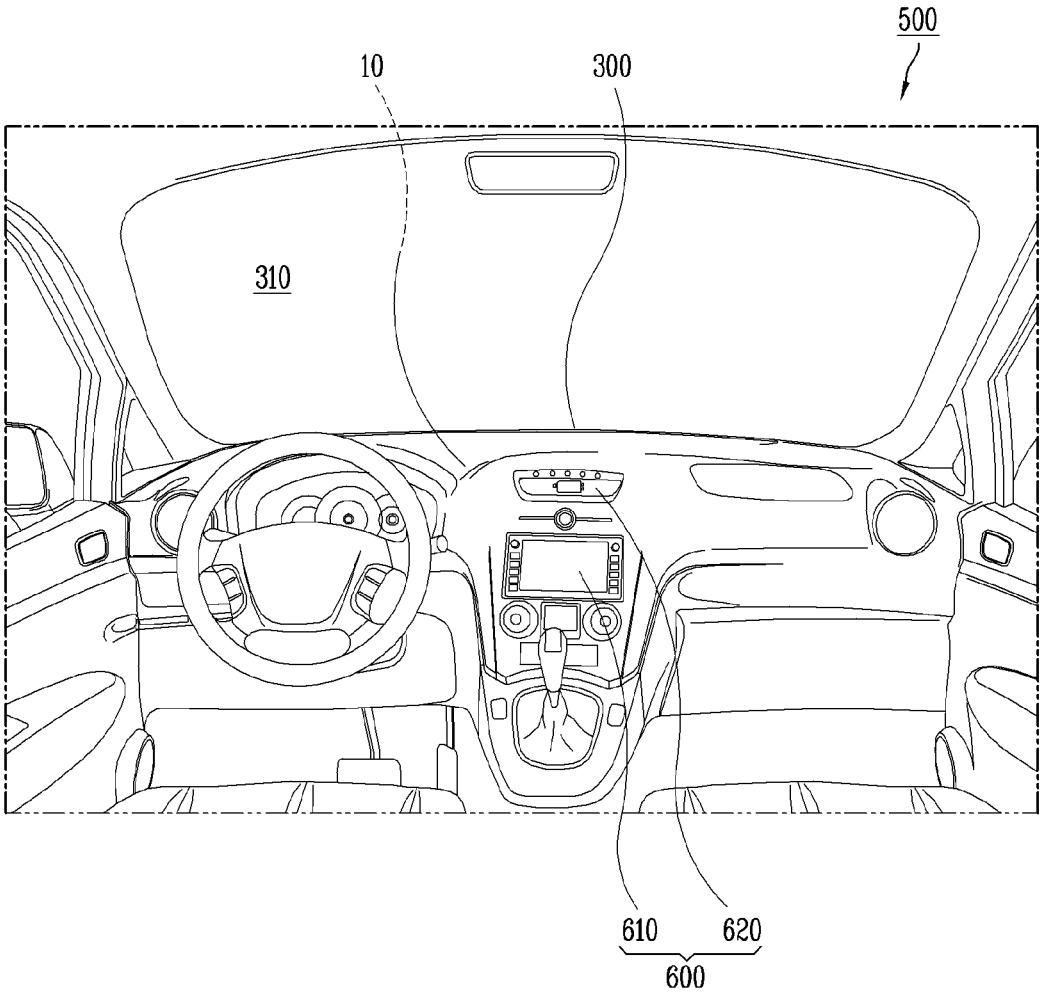
FIG. 1A is a diagram illustrating a vehicle interior in accordance with one example.
Figure 1B:
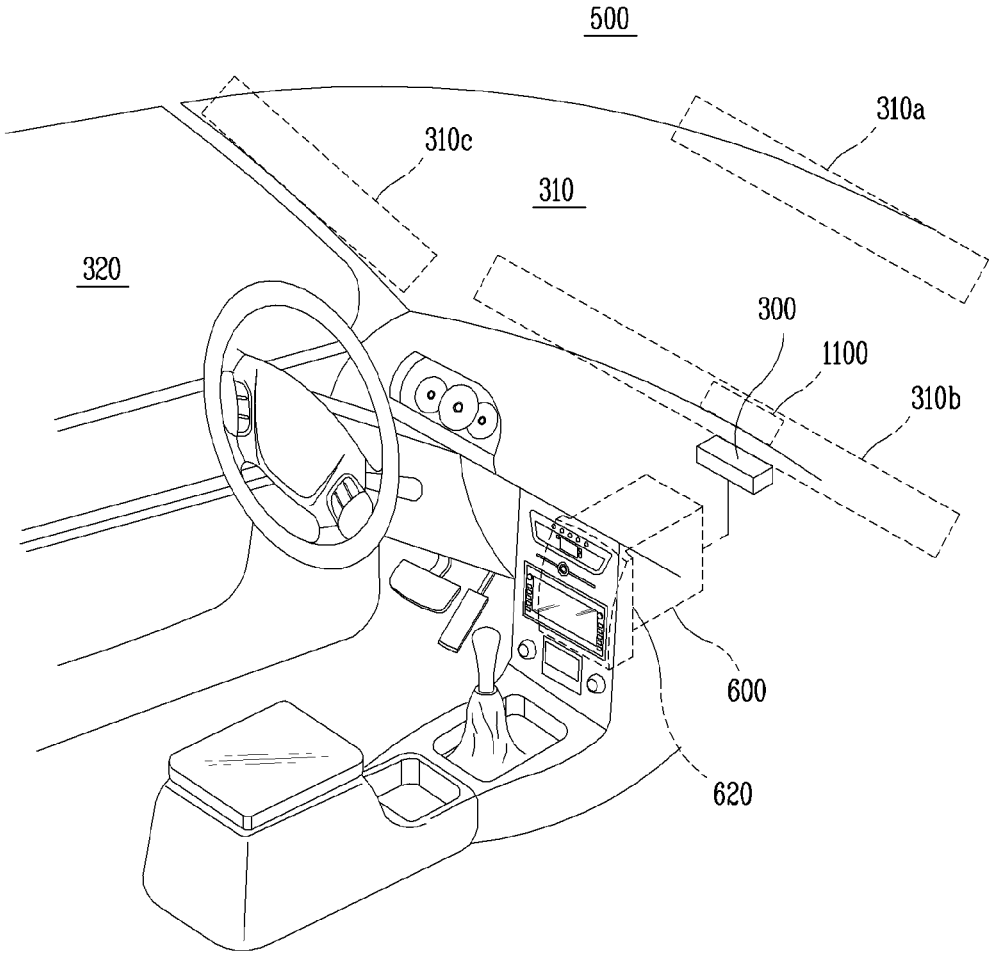
FIG. 1B is a lateral view illustrating the vehicle interior in accordance with the one example.

FIG. 1A is a diagram illustrating a vehicle interior in accordance with one example. FIG. 1B is a lateral view illustrating the vehicle interior in accordance with the one example.

As illustrated in FIGS. 1A and 1B, the present disclosure describes an antenna unit (i.e., an internal antenna system) 1000 capable of transmitting and receiving signals through GPS, 4G wireless communication, 5G wireless communication, Bluetooth, or wireless LAN. Therefore, the antenna unit (i.e., the antenna system) 1000 capable of supporting these various communication protocols may be referred to as an integrated antenna module 1000. The antenna system 1000 may include a telematics control unit (TCU) 300 and an antenna assembly 1100. For example, the antenna assembly 1100 may be disposed on a window of a vehicle.

The present disclosure also describes a vehicle 500 having the antenna system 1000. The vehicle 500 may include a dashboard and a housing 10 including the telematics control unit (TCU) 300, and the like. In addition, the vehicle 500 may include a mounting bracket for mounting the telematics control unit (TCU) 300.

The vehicle 500 may include the telematics control unit (TCU) 300 and an infotainment unit 600 configured to be connected to the telematics control unit 300. A portion of a front pattern of the infotainment unit 600 may be implemented in the form of a dashboard of the vehicle. A display 610 and an audio unit 620 may be included in the dashboard of the vehicle.

The antenna assembly 1100, namely, the antenna module 1100 in the form of a transparent antenna may be disposed at at least one of an upper region 310*a*, a lower region 310*b*, and a side region 310*c* of a front window 310. The antenna assembly 1100 may also be disposed at a side window 320, which is disposed at a side surface of the vehicle, in addition to the front window 310.

As illustrated in FIG. 1B, when the antenna assembly 1100 is disposed at the lower region 310*b* of the front window 310, it may be operably coupled to a TCU 300 disposed inside the vehicle. When the antenna assembly 1100 is disposed at the upper region 310*a* or the side region 310*c* of the front window 310, it may be operably coupled to a TCU disposed outside the vehicle. However, the present disclosure may not be limited to the TCU coupling configuration inside or outside the vehicle.

<V2X (Vehicle-to-Everything)>

V2X communication may include communications between a vehicle and all entities, such as V2V (Vehicle-to-Vehicle) which refers to communication between vehicles, V2I (Vehicle-to-Infrastructure) which refers to communication between a vehicle and an eNB or RSU (Road Side Unit), V2P (Vehicle-to-Pedestrian) which refers to communication between a vehicle and a terminal possessed by a person (pedestrian, cyclist, vehicle driver, or passenger), V2N (vehicle-to-network), and the like.

V2X communication may indicate the same meaning as V2X sidelink or NR V2X or may indicate a broader meaning including V2X sidelink or NR V2X.

V2X communication can be applied to various services, for example, forward collision warning, automatic parking system, Cooperative Adaptive Cruise Control (CACC), control loss warning, traffic queue warning, traffic vulnerable safety warning, emergency vehicle warning, speed warning when driving on a curved road, traffic flow control, and the like.

V2X communication may be provided through a PC5 interface and/or a Uu interface. In this case, specific network entities for supporting communications between a vehicle and all entities may exist in a wireless communication system supporting V2X communication. For example, the network entity may include a base station (eNB), a Road Side Unit (RSU), a terminal, or an application server (e.g., a traffic safety server).

In addition, a terminal performing V2X communication may refer to not only a general handheld UE but also a vehicle (V-UE), a pedestrian UE, an RSU of an eNB type, an RSU of a UE type, a robot equipped with a communication module, and the like.

V2X communication may be performed directly between terminals or may be performed through the network entity (entities). V2X operation modes may be classified according to a method of performing such V2X communication.

Terms used in V2X communication may be defined as follows.

A Road Side Unit (RSU) is a V2X service enabled device that can transmit and receive data to and from a moving vehicle using V2I service. The RSU is also a stationary infrastructure entity supporting V2X application programs, and can exchange messages with other entities that support V2X application programs. The RSU is a term frequently used in existing ITS specifications, and the reason for introducing this term to the 3GPP specifications is to make the documents easier to read for the ITS industry. The RSU is a logical entity that combines a V2X application logic with the functionality of an eNB (referred to as an eNB-type RSU) or a UE (referred to as a UE-type RSU).

V2I Service is a type of V2X service, where one party is a vehicle whereas the other party is an entity belonging to infrastructure. V2P Service is also a type of V2X service, where one party is a vehicle and the other party is a device carried by an individual (e.g., a handheld terminal carried by a pedestrian, a cyclist, a driver, or a passenger). V2X Service is a type of 3GPP communication service that involves a transmitting or receiving device on a vehicle. Based on the other party involved in the communication, it may be further divided into V2V service, V2I service and V2P service.

V2X enabled UE is a UE that supports V2X service. V2V Service is a type of V2X service, where both parties of communication are vehicles. V2V communication range is a direct communication range between two vehicles engaged in V2V service.

Figure 2A:
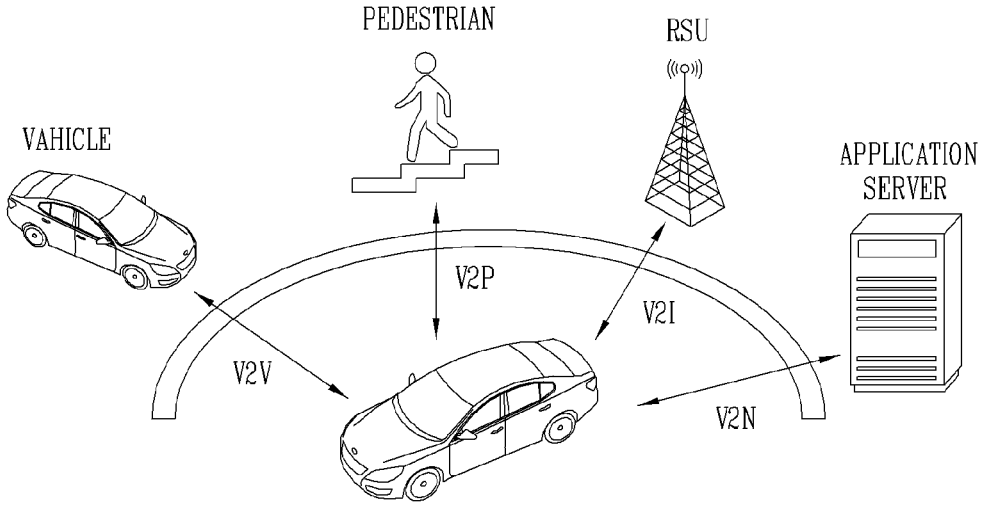
FIG. 2A illustrates a type of V2X application.

V2X applications, referred to as Vehicle-to-Everything (V2X), include the four different types, as described above, namely, (1) vehicle-to-vehicle (V2V), (2) vehicle-to-infrastructure (V2I), (3) vehicle-to-network (V2N), (4) vehicle-to-pedestrian (V2P). FIG. 2A illustrates a type of V2X application. Referring to FIG. 2A, the four types of V2X applications may use "cooperative awareness" to provide more intelligent services for end-users.

This means that entities, such as vehicles, roadside infrastructures, application servers and pedestrians, may collect knowledge of their local environments (e.g., information received from other vehicles or sensor equipment in proximity) to process and share that knowledge in order to provide more intelligent services, such as cooperative collision warning or autonomous driving.

<NR V2X>

Support for V2V and V2X services has been introduced in LTE during Releases 14 and 15, in order to expand the 3GPP platform to the automotive industry.

Requirements for support of enhanced V2X use cases are broadly arranged into four use case groups.

(1) Vehicles Platooning enables the vehicles to dynamically form a platoon traveling together. All the vehicles in the platoon obtain information from the leading vehicle to manage this platoon. These information allow the vehicles to drive closer than normal in a coordinated manner, going to the same direction and traveling together.

(2) Extended Sensors enable the exchange of raw or processed data gathered through local sensors or live video images among vehicles, road site units, devices of pedestrians and V2X application servers. The vehicles can increase the perception of their environment beyond of what their own sensors can detect and have a more broad and holistic view of the local situation. High data rate is one of the key characteristics.

(3) Advanced Driving enables semi-automated or full-automated driving. Each vehicle and/or RSU shares its own perception data obtained from its local sensors with vehicles in proximity and allows vehicles to synchronize and coordinate their trajectories or maneuvers. Each vehicle shares its driving intention with vehicles in proximity too.

(4) Remote Driving enables a remote driver or a V2X application to operate a remote vehicle for those passengers who cannot drive by themselves or remote vehicles located in dangerous environments. For a case where variation is limited and routes are predictable, such as in public transportation, driving based on cloud computing can be used. High reliability and low latency are the main requirements.

A description to be given below can be applied to all of NR SL (sidelink) and LTE SL, and when no radio access technology (RAT) is indicated, the NR SL is meant. Operation scenarios considered in NR V2X may be categorized into six as follows. In this regard, FIG. 2B illustrates a standalone scenario supporting V2X SL communication and an MR-DC scenario supporting V2X SL communication.

In particular, 1) in scenario 1, a gNB provides control/configuration for a UE's V2X communication in both LTE SL and NR SL. 2) In scenario 2, an ng-eNB provides control/configuration for a UE's V2X communication in both LTE SL and NR SL. 3) In scenario 3, an eNB provides control/configuration for a UE's V2X communication in both LTE SL and NR SL. On the other hand, 4) in scenario 4, a UE's V2X communication in LTE SL and NR SL is controlled/configured by Uu while the UE is configured with EN-DC. 5) In scenario 5, a UE's V2X communication in LTE SL and NR SL is controlled/configured by Uu while the UE is configured in NE-DC. 6) In scenario 6, a UE's V2X communication in LTE SL and NR SL is controlled/configured by Uu while the UE is configured in NGEN-DC.

Figure 2B:
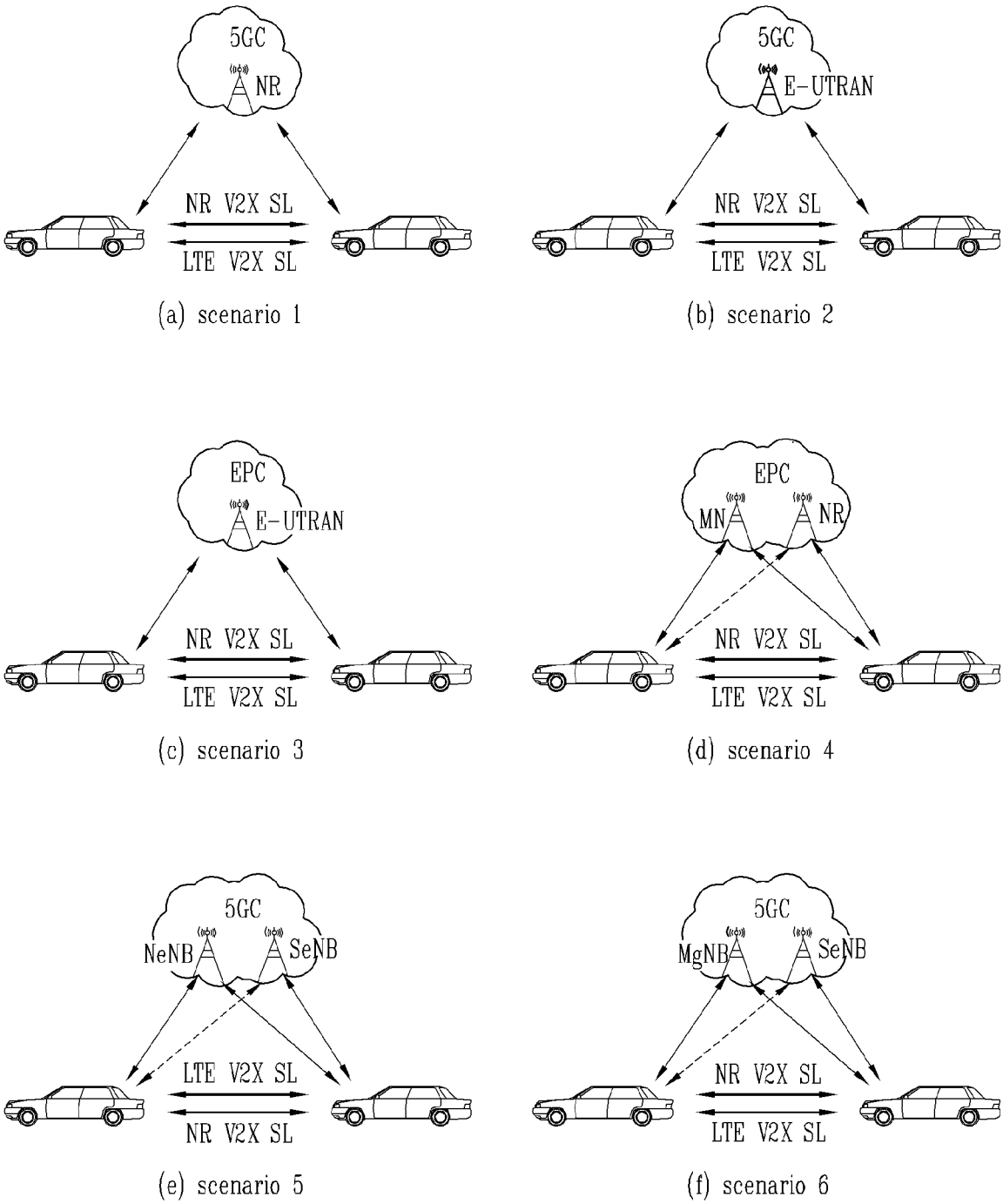
FIG. 2B illustrates a standalone scenario supporting V2X SL communication and an MR-DC scenario supporting V2X SL communication.

In order to support V2X communication, as illustrated in FIGS. 2A and 2B, a vehicle may perform wireless communication with an eNB and/or a gNB through an antenna system. The antenna system may be configured as an internal antenna system as illustrated in FIGS. 1A and 1B. The antenna system may alternatively be implemented as an external antenna system and/or an internal antenna system as illustrated in FIGS. 3A to 3C.

Figure 3A:
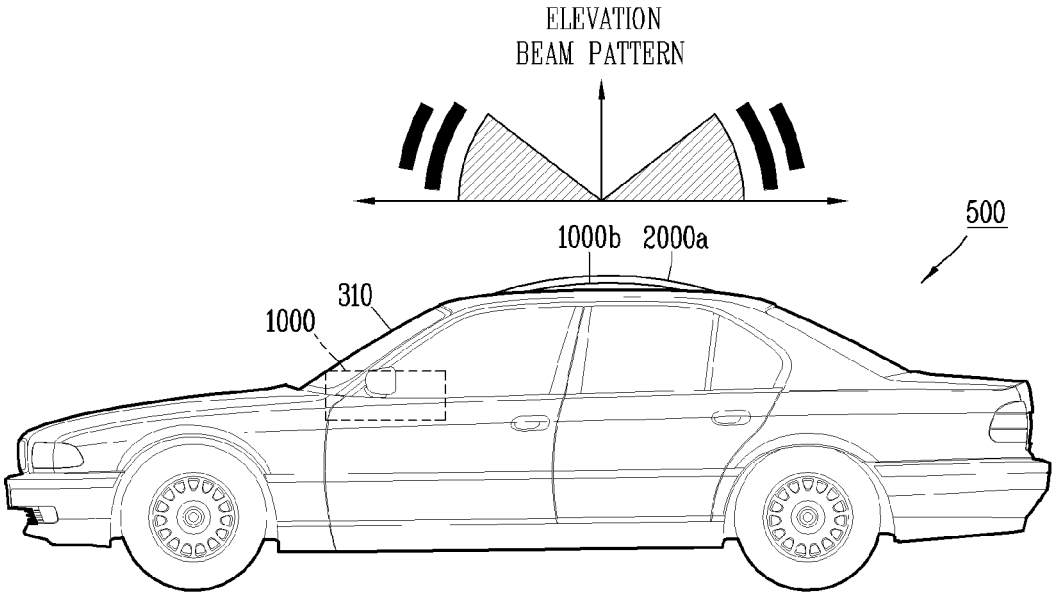
FIGS. 3A to 3C are views illustrating a structure for mounting an antenna system in a vehicle, to which the antenna system is mounted.
Figure 3B:
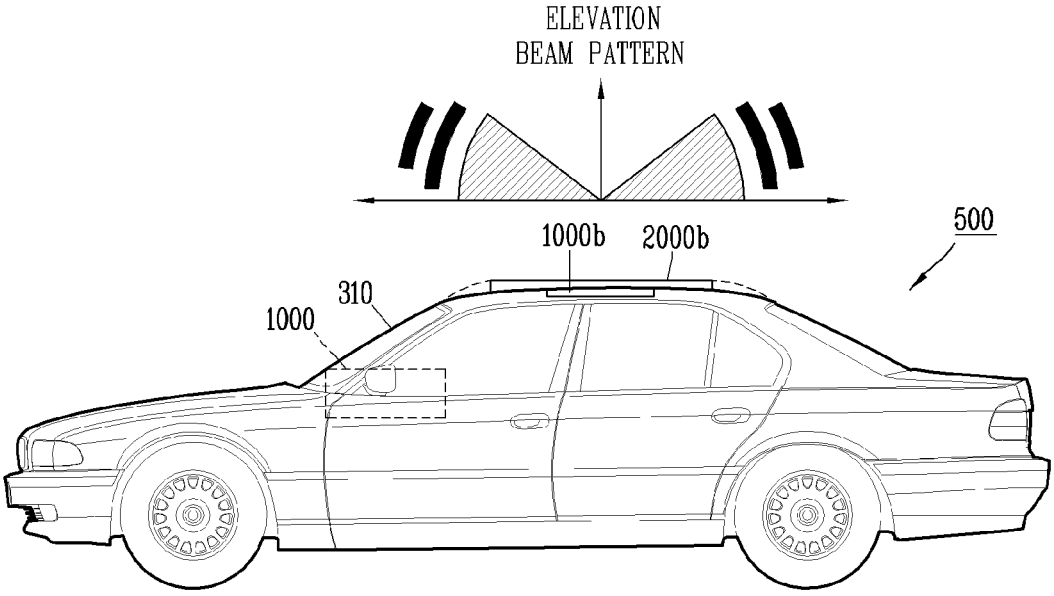
Figure 3C:
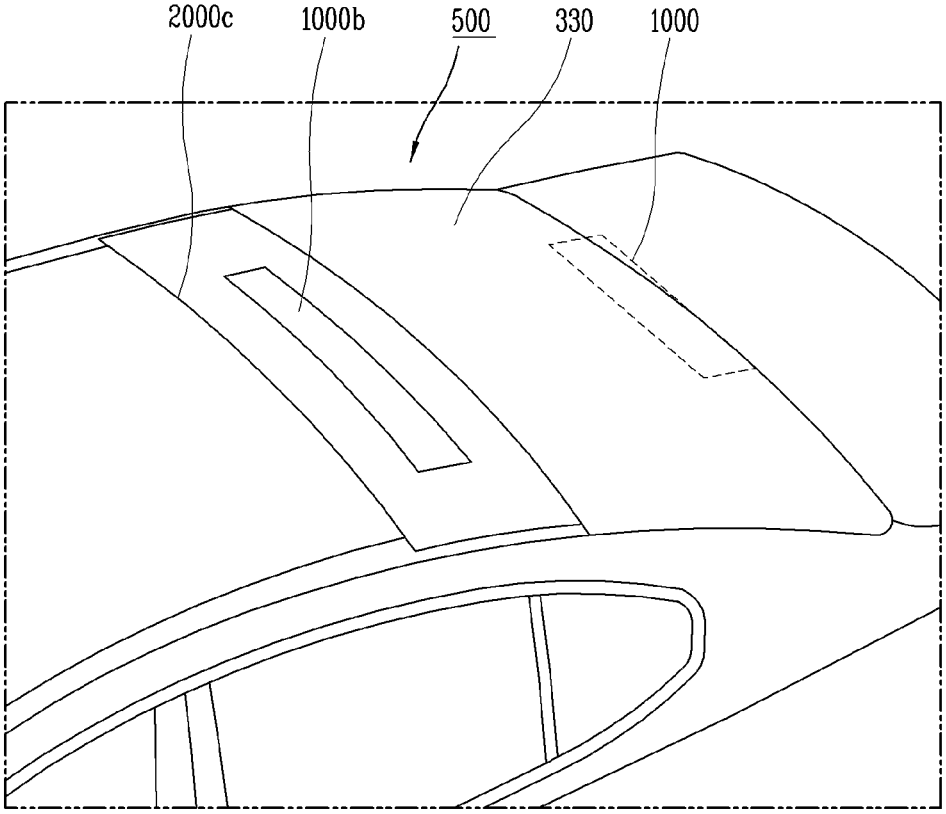

FIGS. 3A to 3C are views illustrating a structure for mounting an antenna system in a vehicle, to which the antenna system is mounted. In this regard, FIGS. 3A to 3C illustrate a configuration capable of performing wireless communication through a transparent antenna disposed on the front window 310 of the vehicle. An antenna system 1000 including a transparent antenna may be disposed on a front window of a vehicle and inside the vehicle. Wireless communication may also be performed through a transparent antenna disposed on a side glass of the vehicle, in addition to the front window.

The antenna system for the vehicle that includes the transparent antenna can be combined with other antennas. Referring to FIGS. 3A to 3C, in addition to the antenna system 1000 implemented as the transparent antenna, a separate antenna system 1000*b* may be further configured. FIGS. 3A and 3B illustrate a structure in which the antenna system 1000*b*, in addition to the antenna system 1000, is mounted on or in a roof of the vehicle. On the other hand, FIG. 3C illustrates a structure in which the separate antenna system 1000*b*, in addition to the antenna system 1000, is mounted in a roof frame of a roof and a rear mirror of the vehicle.

Referring to FIGS. 3A to 3C, in order to improve the appearance of the vehicle and to maintain a telematics performance at the time of collision, an existing shark fin antenna may be replaced with a flat antenna of a non-protruding shape. In addition, the present disclosure proposes an integrated antenna of an LTE antenna and a 5G antenna considering fifth generation (5G) communication while providing the existing mobile communication service (e.g., LTE).

Referring to FIG. 3A, the antenna system 1000 implemented as the transparent antenna may be disposed on the front window 310 of the vehicle and inside the vehicle. The second antenna system 1000*b* corresponding to an external antenna may be disposed on the roof of the vehicle. In FIG. 3A, a radome 2000*a* may cover the second antenna system 1000*b* to protect the second antenna system 1000*b* from an external environment and external impacts while the vehicle travels. The radome 2000*a* may be made of a dielectric material through which radio signals are transmitted/received between the second antenna system 1000*b* and a base station.

Referring to FIG. 3B, the antenna system 1000 implemented as the transparent antenna may be disposed on the front window 310 of the vehicle and inside the vehicle. One the other hand, the second antenna system 1000*b* corresponding to the external antenna may be disposed within a roof structure of the vehicle and at least part of the roof structure 2000*b* may be made of a non-metallic material. At this time, the roof structure 2000*b* of the vehicle except for the at least part made of the non-metallic material may be made of a dielectric material through which radio signals are transmitted/received between the antenna system 1000*b* and the base station.

Referring to FIG. 3C, the antenna system 1000 implemented as the transparent antenna may be disposed on the rear window 330 of the vehicle and inside the vehicle. The second antenna system 1000*b* corresponding to the external antenna may be disposed within the roof frame 2000*c* of the vehicle, and at least part of the roof frame 2000*c* may be made of a non-metallic material. At this time, the roof frame 2000*c* of the vehicle 500 except for the at least part made of the non-metallic material may be made of a dielectric material through which radio signals are transmitted/received between the second antenna system 1000*b* and the base station.

Referring to FIGS. 3A to 3C, antennas provided in the antenna system 1000 mounted on the vehicle may form a beam pattern in a direction perpendicular to the front window 310 or the rear window 330. Antenna provided in the second antenna system 1000 mounted on the vehicle may further define a beam coverage by a predetermined angle in a horizontal region with respect to the vehicle body.

Meanwhile, the vehicle 500 may include only the antenna unit (i.e., the internal antenna system) 1000 corresponding to the internal antenna without the antenna system 1000*b* corresponding to the external antenna.

Figure 4:
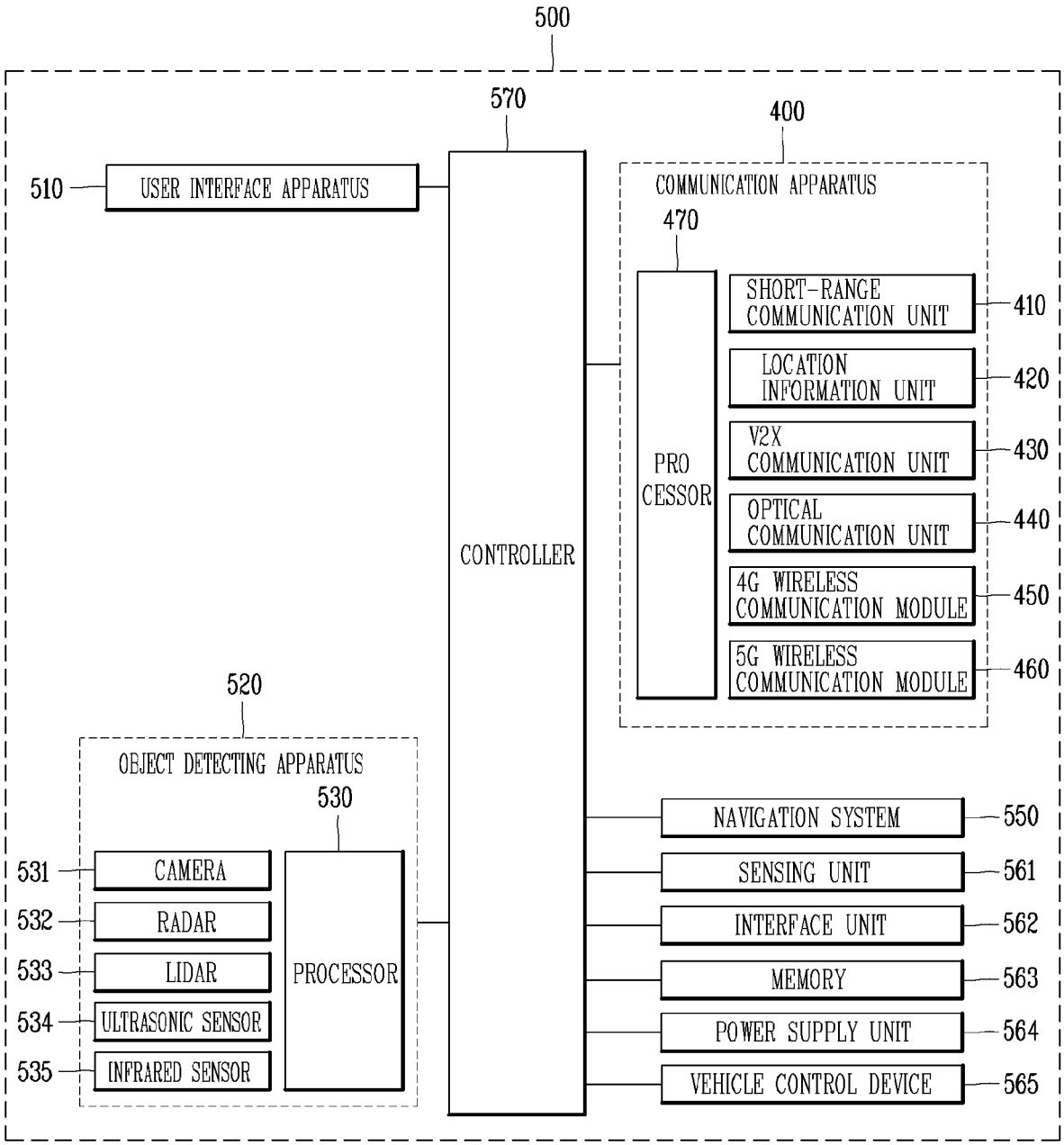
FIG. 4 is a block diagram illustrating a vehicle and an antenna system mounted to the vehicle in accordance with one example.

Meanwhile, FIG. 4 is a block diagram illustrating a vehicle and an antenna system mounted on the vehicle in accordance with an implementation.

The vehicle 500 may be an autonomous vehicle. The vehicle 500 may be switched into an autonomous driving mode or a manual mode (a pseudo driving mode) based on a user input. For example, the vehicle 500 may be switched from the manual mode into the autonomous driving mode or from the autonomous driving mode into the manual mode based on a user input received through a user interface apparatus 510.

In relation to the manual mode and the autonomous driving mode, operations such as object detection, wireless communication, navigation, and operations of vehicle sensors and interfaces may be performed by the telematics control unit mounted on the vehicle 500. Specifically, the telematics control unit mounted on the vehicle 500 may perform the operations in cooperation with the antenna module 300, the object detecting apparatus 520, and other interfaces. In some examples, the communication apparatus 400 may be disposed in the telematics control unit separately from the antenna system 300 or may be disposed in the antenna system 300.

The vehicle 500 may be switched into the autonomous driving mode or the manual mode based on driving environment information. The driving environment information may be generated based on object information provided from the object detecting apparatus 520. For example, the vehicle 500 may be switched from the manual mode into the autonomous driving mode or from the autonomous driving mode into the manual mode based on driving environment information generated in the object detecting apparatus 520.

For example, the vehicle 500 may be switched from the manual mode into the autonomous driving mode or from the autonomous driving mode into the manual mode based on driving environment information received through the communication apparatus 400. The vehicle 500 may be switched from the manual mode into the autonomous driving mode or from the autonomous driving mode into the manual mode based on information, data or signal provided from an external device.

When the vehicle 500 is driven in the autonomous driving mode, the autonomous vehicle 500 may be driven based on an operation system. For example, the autonomous vehicle 500 may be driven based on information, data or signal generated in a driving system, a parking exit system, and a parking system. When the vehicle 500 is driven in the manual mode, the autonomous vehicle 500 may receive a user input for driving through a driving control apparatus. The vehicle 500 may be driven based on the user input received through the driving control apparatus.

The vehicle 500 may include a user interface apparatus 510, an object detecting apparatus 520, a navigation system 550, and a communication apparatus 400. In addition, the vehicle may further include a sensing unit 561, an interface unit 562, a memory 563, a power supply unit 564, and a vehicle control device 565 in addition to the aforementioned apparatuses and devices. In some implementations, the vehicle 500 may include more components in addition to components to be explained in this specification or may not include some of those components to be explained in this specification.

The user interface apparatus 510 may be an apparatus for communication between the vehicle 500 and a user. The user interface apparatus 510 may receive a user input and provide information generated in the vehicle 500 to the user. The vehicle 510 may implement user interfaces (UIs) or user experiences (UXs) through the user interface apparatus 200.

The object detecting apparatus 520 may be an apparatus for detecting an object located at outside of the vehicle 500. The object may be a variety of objects associated with driving (operation) of the vehicle 500. In some examples, objects may be classified into moving objects and fixed (stationary) objects. For example, the moving objects may include other vehicles and pedestrians. The fixed objects may include traffic signals, roads, and structures, for example. The object detecting apparatus 520 may include a camera 521, a radar 522, a LiDAR 523, an ultrasonic sensor 524, an infrared sensor 525, and a processor 530. In some implementations, the object detecting apparatus 520 may further include other components in addition to the components described, or may not include some of the components described.

The processor 530 may control an overall operation of each unit of the object detecting apparatus 520. The processor 530 may detect an object based on an acquired image, and track the object. The processor 530 may execute operations, such as a calculation of a distance from the object, a calculation of a relative speed with the object and the like, through an image processing algorithm.

In some implementations, the object detecting apparatus 520 may include a plurality of processors 530 or may not include any processor 530. For example, each of the camera 521, the radar 522, the LiDAR 523, the ultrasonic sensor 524 and the infrared sensor 525 may include the processor in an individual manner.

When the processor 530 is not included in the object detecting apparatus 520, the object detecting apparatus 520 may operate according to the control of a processor of an apparatus within the vehicle 500 or the controller 570.

The navigation system 550 may provide location information related to the vehicle based on information obtained through the communication apparatus 400, in particular, a location information unit 420. Also, the navigation system 550 may provide a path (or route) guidance service to a destination based on current location information related to the vehicle. In addition, the navigation system 550 may provide guidance information related to surroundings of the vehicle based on information obtained through the object detecting apparatus 520 and/or a V2X communication unit 430. In some examples, guidance information, autonomous driving service, etc. may be provided based on V2V, V2I, and V2X information obtained through a wireless communication unit operating together with the antenna system 1000.

The communication apparatus 400 may be an apparatus for performing communication with an external device. Here, the external device may be another vehicle, a mobile terminal, or a server. The communication apparatus 400 may perform the communication by including at least one of a transmitting antenna, a receiving antenna, and radio frequency (RF) circuit and RF device for implementing various communication protocols. The communication apparatus 400 may include a short-range communication unit 410, a location information unit 420, a V2X communication unit 430, an optical communication unit 440, a 4G wireless communication module 450, and a processor 470. According to an embodiment, the communication apparatus 400 may further include other components in addition to the components described, or may not include some of the components described.

The short-range communication unit 410 is a unit for facilitating short-range communications. The short-range communication unit 410 may construct short-range wireless area networks to perform short-range communication between the vehicle 500 and at least one external device. The location information unit 420 may be a unit for acquiring location information related to the vehicle 500. For example, the location information unit 420 may include a Global Positioning System (GPS) module or a Differential Global Positioning System (DGPS) module.

The V2X communication unit 430 may be a unit for performing wireless communication with a server (Vehicle to Infrastructure; V2I), another vehicle (Vehicle to Vehicle; V2V), or a pedestrian (Vehicle to Pedestrian; V2P). The V2X communication unit 430 may include an RF circuit implementing communication protocols such as V2I, V2V, and V2P. The optical communication unit 440 is a unit for performing communication with an external device through the medium of light. The optical communication unit 440 may include a light-emitting diode for converting an electric signal into an optical signal and sending the optical signal to the exterior, and a photodiode for converting the received optical signal into an electric signal. In some implementations, the light-emitting diode may be integrated with lamps provided on the vehicle 500.

The wireless communication unit 460 is a unit that performs wireless communications with one or more communication systems through one or more antenna systems. The wireless communication unit 460 may transmit and/or receive a signal to and/or from a device in a first communication system through a first antenna system. In addition, the wireless communication unit 460 may transmit and/or receive a signal to and/or from a device in a second communication system through a second antenna system. For example, the first communication system and the second communication system may be an LTE communication system and a 5G communication system, respectively. However, the first communication system and the second communication system may not be limited thereto, and may be changed according to applications.

In some examples, the antenna module 300 disposed in the vehicle 500 may include a wireless communication unit. In this regard, the vehicle 500 may be an electric vehicle (EV) or a vehicle that can be connected to a communication system independently of an external electronic device. In this regard, the communication apparatus 400 may include at least one of the short-range communication unit 410, the location information unit 420, the V2X communication unit 430, the optical communication unit 440, a 4G wireless communication module 450, and a 5G wireless communication module 460.

The 4G wireless communication module 450 may perform transmission and reception of 4G signals with a 4G base station through a 4G mobile communication network. In this case, the 4G wireless communication module 450 may transmit at least one 4G transmission signal to the 4G base station. In addition, the 4G wireless communication module 450 may receive at least one 4G reception signal from the 4G base station. In this regard, Uplink (UL) Multi-input and Multi-output (MIMO) may be performed by a plurality of 4G transmission signals transmitted to the 4G base station. In addition, Downlink (DL) MIMO may be performed by a plurality of 4G reception signals received from the 4G base station.

The 5G wireless communication module 460 may perform transmission and reception of 5G signals with a 5G base station through a 5G mobile communication network. Here, the 4G base station and the 5G base station may have a Non-Stand-Alone (NSA) structure. The 4G base station and the 5G base station may be disposed in the Non-Stand-Alone (NSA) structure. Alternatively, the 5G base station may be disposed in a Stand-Alone (SA) structure at a separate location from the 4G base station. The 5G wireless communication module 460 may perform transmission and reception of 5G signals with a 5G base station through a 5G mobile communication network. In this case, the 5G wireless communication module 460 may transmit at least one 5G transmission signal to the 5G base station. In addition, the 5G wireless communication module 460 may receive at least one 5G reception signal from the 5G base station. In this instance, 5G and 4G networks may use the same frequency band, and this may be referred to as LTE refarming. In some examples, a Sub 6 frequency band, which is a range of 6 GHz or less, may be used as the 5G frequency band. On the other hand, a millimeter-wave (mmWave) range may be used as the 5G frequency band to perform wideband high-speed communication. When the mmWave band is used, the electronic device may perform beamforming for communication coverage expansion with a base station.

On the other hand, regardless of the 5G frequency band, 5G communication systems can support a larger number of MIMOs to improve a transmission rate. In this instance, UL MIMO may be performed by a plurality of 5G transmission signals transmitted to a 5G base station. In addition, DL MIMO may be performed by a plurality of 5G reception signals received from the 5G base station.

In some examples, the wireless communication unit 110 may be in a Dual Connectivity (DC) state with the 4G base station and the 5G base station through the 4G wireless communication module 450 and the 5G wireless communication module 460. As such, the dual connectivity with the 4G base station and the 5G base station may be referred to as EUTRAN NR DC (EN-DC). On the other hand, if the 4G base station and 5G base station are disposed in a co-located structure, throughput improvement can be achieved by inter-Carrier Aggregation (inter-CA). Accordingly, when the 4G base station and the 5G base station are disposed in the EN-DC state, the 4G reception signal and the 5G reception signal may be simultaneously received through the 4G wireless communication module 450 and the 5G wireless communication module 460. Short-range communication between electronic devices (e.g., vehicles) may be performed using the 4G wireless communication module 450 and the 5G wireless communication module 460. In some implementations, after resources are allocated, vehicles may perform wireless communication in a V2V manner without a base station.

Meanwhile, for transmission rate improvement and communication system convergence, Carrier Aggregation (CA) may be carried out using at least one of the 4G wireless communication module 450 and the 5G wireless communication module 460 and a WiFi communication module. In this regard, 4G+WiFi CA may be performed using the 4G wireless communication module 450 and the Wi-Fi communication module. Or, 5G+WiFi CA may be performed using the 5G wireless communication module 460 and the Wi-Fi communication module.

In some examples, the communication apparatus 400 may implement a display apparatus for a vehicle together with the user interface apparatus 510. In this instance, the display apparatus for the vehicle may be referred to as a telematics apparatus or an Audio Video Navigation (AVN) apparatus.

Hereinafter, an antenna assembly (antenna module) that may be disposed on a window of a vehicle according to the present disclosure and an antenna system for a vehicle including the antenna assembly will be described. In this regard, the antenna assembly may refer to a structure in which conductive patterns are combined on a dielectric substrate, and may also be referred to as an antenna module.

Figure 5:
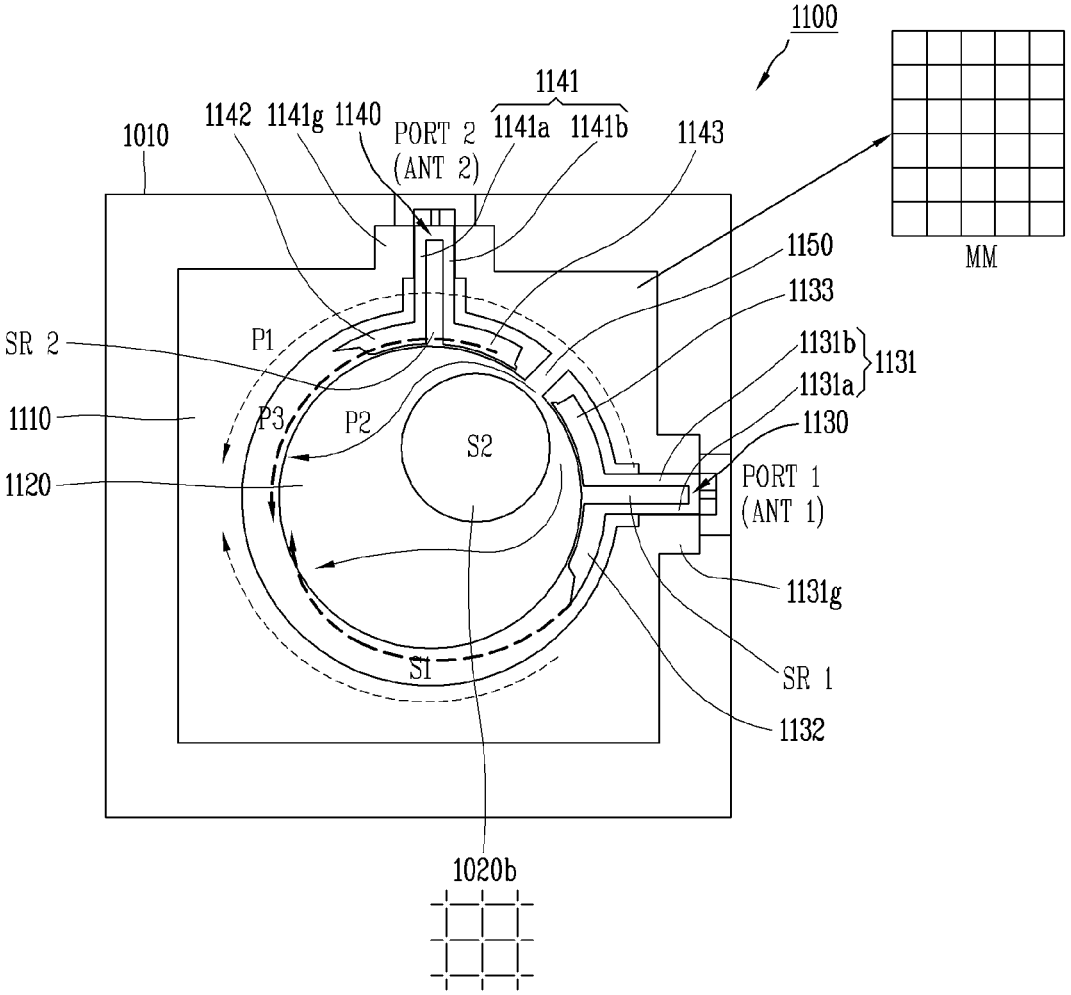
FIG. 5 is a view illustrating a detailed configuration of an antenna assembly in accordance with one example.
Figure 6A:
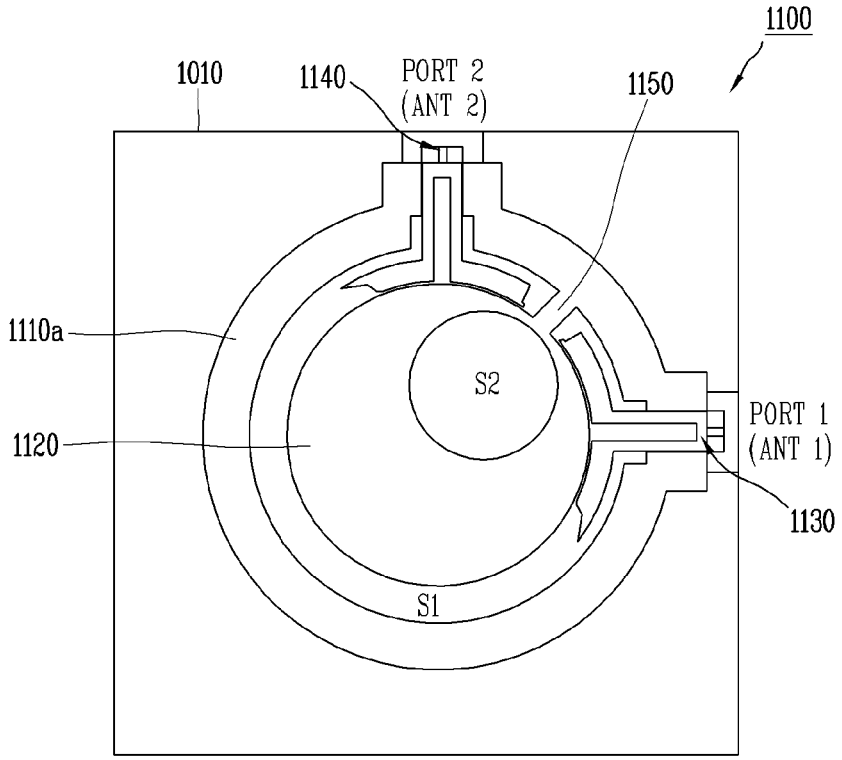
FIGS. 6A to 6C illustrate an antenna assembly in accordance with various examples.
Figure 6B:
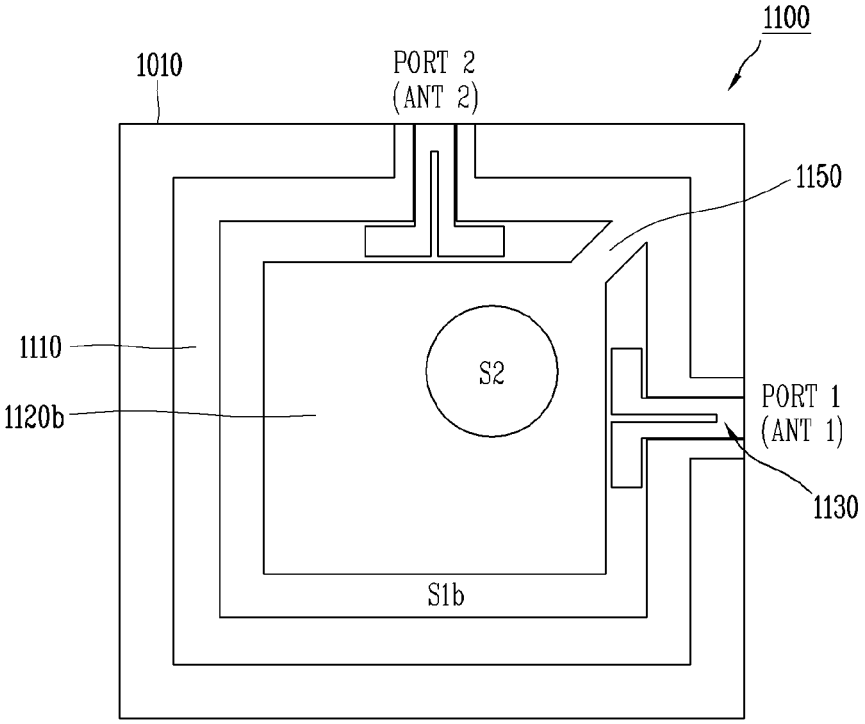
Figure 6C:
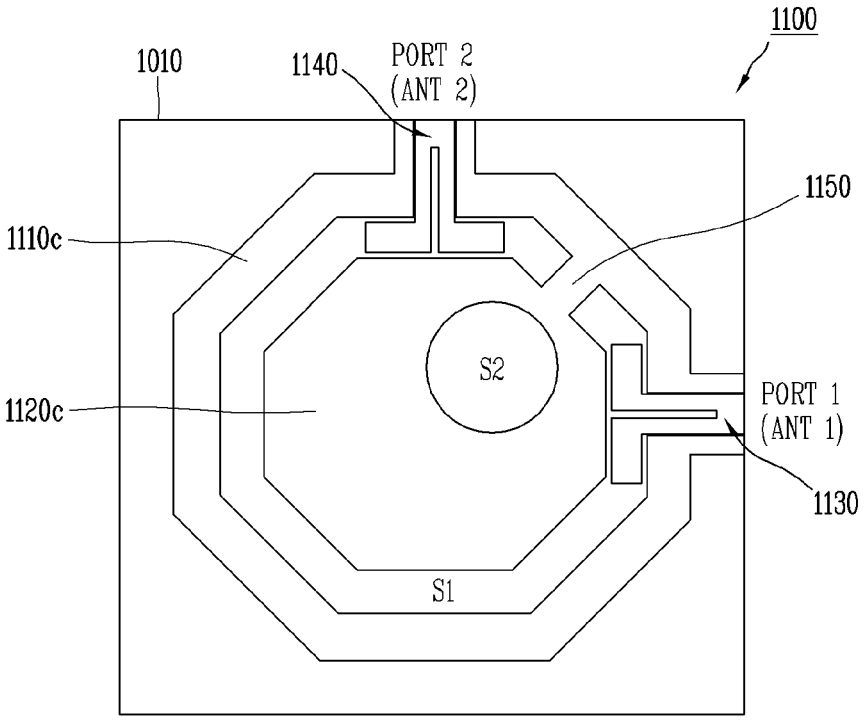

FIG. 5 is a view illustrating a detailed configuration of an antenna assembly in accordance with one example. FIGS. 6A to 6C illustrate an antenna assembly in accordance with various examples. Referring to FIG. 5, a structure having a circular slot defined by a square patch and a circular patch is illustrated. FIG. 6A illustrates a structure in which a circular slot is defined between a plurality of circular patches. FIG. 6B illustrates a structure in which a square slot is defined between a plurality of square patches. FIG. 6C illustrates a structure in which a polygonal slot is defined between a plurality of polygonal patches. Referring to FIGS. 5 to 6C, a circular slot may be defined in a circular/square/polygonal patch disposed at an inner region. In this regard, the circular slot may be replaced with a square slot or a polygonal slot.

Referring to FIGS. 5 to 6C, the antenna assembly 1100 may include a dielectric substrate 1010, a first patch 1110, 1110*a*, 1110*c*, and a second patch 1120, 1120*b*, 1120*c*. In this regard, the first patch 1110, 1110*a*, 1110*c* and the second patch 1120, 1120*b*, 1120*c* may be referred to as radiators. The first patch 1110, 1110*a*, 1110*c* may be implemented as one of a square patch, a circular patch, or a polygonal patch, but may not be limited thereto. The second patch 1120, 1120*b*, 1120*c* may be implemented as one of a circular patch, a square patch, or a polygonal patch, but may not be limited thereto. The antenna system 1100 may further include a first feeding line 1130, a second feeding line 1140, and a connection line 1150.

The first patch 1110, 1110*a*, 1110*c* and the second patch 1120, 1120*b*, 1120*c* may be referred to as an outer patch 1110, 1110*a*, 1110*c* and an inner patch 1120, 1120*b*, 1120*c*, respectively. In some examples, since the first patch 1110, 1110*a*, 1110*c* constitutes an outermost region of a conductive pattern, it may also be referred to as an outermost patch.

The first patch 1110, 1110*a*, 1110*c* may be configured such that a first slot S1 is formed at an inner region of a first conductive pattern that is disposed on the dielectric substrate 1010. The first patch 1110, 1110*a*, 1110*c* may radiate a signal in a first band through the first conductive pattern. The first conductive pattern may be a metal mesh pattern defined by a plurality of mesh grids or may be made of a transparent conductive film for implementing a transparent antenna. In this regard, the first band may be set to a mid band MB associated with 4G/5G wireless communication, but may not be limited thereto.

The second patch 1120, 1120*b*, 1120*c* may be configured such that a second slot S2 is formed at an inner region of a second conductive pattern that is disposed on the dielectric substrate 1010. The second patch 1120, 1120*b*, 1120*c* may alternatively be configured such that the second slot S2 is formed at the inner region of the second conductive pattern that is disposed at an inner region of the first slot S1. The second patch 1120, 1120*b*, 1120*c* may radiate a signal in a second band and a third band through the second conductive pattern. The second conductive pattern may be a metal mesh pattern defined by a plurality of mesh grids or may be made of a transparent conductive film for implementing a transparent antenna. In this regard, the second band may be set to a high band HB associated with 4G/5G wireless communication, but may not be limited thereto. The third band may be a Sub6 band associated with 5G wireless communication, but may not be limited thereto.

The second band may be a band higher than the first band and the third band may be set to a band higher than the second band. For example, the first band corresponding to the MB may be set to 1.71 to 2.17 GHz, but may not be limited thereto. The second band corresponding to the HB may be set to 2.3 to 4.5 GHz or set to 2.5 to 3.1 GHz, but may not be limited thereto. The third band corresponding to the Sub6 band may be set to 4.6 to 6.0 GHz or 5.0 to 6.0 GHz, but may not be limited thereto.

The first feeding line 1130 may be disposed at a first region SR1 of the first slot S1 between an inside of the first patch 1110 and an outside of the second patch 1120. The second feeding line 1140 may be disposed at a second region SR2 of the first slot S1 between the inside of the first patch 1110 and the outside of the second patch 1120. In this regard, the second region SR2 of the first slot S1 may be set to be orthogonal to the first region SR1 of the first slot S1 to correspond to substantially 90 degrees. Accordingly, the second region SR2 may be located at a position orthogonal to the first feeding line 1130. The connection line 1150 may be configured to connect the first patch 1110 and the second patch 1120 between the first feeding line 1130 and the second feeding line 1140.

In some examples, the feeding lines 1130 and 1140 of the antenna assembly structure may be implemented in a Coplanar Waveguide (CPW) structure in which a ground is disposed on the same plane. In this regard, the antenna assembly structure disposed on the window of the vehicle may be configured as a transparent antenna structure. In some examples, the antenna structure disposed on the window of the vehicle may be configured as a single-layered structure in which a radiator, a power supply unit, and a ground are disposed on the same plane. A multi-layered structure may also be considered by specially manufacturing a vehicle window so that a ground is disposed on a different plane from a radiator and a power supply unit. However, for of implementation and antenna integration, the antenna structure may be configured as the single-layered structure in which a CPW feeding unit and a radiator are disposed on the same plane.

In this regard, the first feeding line 1130 may configure a first CPW feeding structure 1130 in which ground patterns 1131*g* are disposed at both sides of a signal line 1131. The signal line 1131 may include therein a first signal line 1131*a* and a second signal line 1131*b* spaced apart by a dielectric region. The first signal line 1131*a* and the second signal line 1131*b* may extend along the inside of the first patch 1110, 1110*a*, 1110*c* and the outside of the second patch 1120, 1120*b*, 1120*c*.

In some examples, the second feeding line 1140 may also configure a second CPW feeding structure 1140, similar to the first feeding line 1130. The second feeding line 1140 may configure a second CPW feeding structure 1140 in which ground patterns 1141*g* are disposed at both sides of a signal line 1141. The signal line 1141 may include a first signal line 1141*a* and a second signal line 1141*b*, similar to the configuration of the first feeding line 1130. In other words, the signal line 1141 may include therein a first signal line 1141*a* and a second signal line 1141*b* spaced apart by a dielectric region. The first signal line 1141*a* and the second signal line

1141*b* may extend along the inside of the first patch 1110, 1110*a*, 1110*c* and the outside of the second patch 1120, 1120*b*, 1120*c*.

The first patch 1110, 1110*a*, 1110*c* corresponding to the inner patch and the second patch 1120, 1120*b*, 1120*c* corresponding to the outer patch may be electrically connected to the ground patterns. In this regard, the first patch 1110, 1110*a*, 1110*c* may be integrally formed with the ground patterns 1131*g* of the first CPW feeding structure 1130. Also, the first patch 1110, 1110*a*, 1110*c* may be integrally formed with the ground patterns 1141*g* of the second CPW feeding structure 1140. The second patch 1120, 1120*b*, 1120*c* may be connected to the first patch 1110, 1110*a*, 1110*c* by the connection line 1150. Accordingly, the second patch 1120, 1120*b*, 1120*c* may be integrally formed with the ground patterns 1131*g* of the first CPW feeding structure 1130. Also, the second patch 1120, 1120*b*, 1120*c* may be integrally formed with the ground patterns 1141*g* of the second CPW feeding structure 1140.

As described above, with reference to FIGS. 5 to 6C, the antenna assembly structure can be configured by the combination of the inner patch and the outer patch of various shapes and slots. Referring to FIG. 5, the second slot S2 defined inside the second patch 1120 may be a circular slot. In some examples, the circular slot S2 may be offset from a center of the second patch 1120 to be disposed adjacent to the connection line 1150. The first patch 1110 may be formed in a square shape and the second patch 1120 may be formed in a circular shape. The first slot S1 and the second slot S2 may be formed in a circular shape.

Referring to FIG. 6A, the inner patch may also be configured as a circular patch. Therefore, the first patch 1110*a* may be formed in a circular shape and the second patch 1120 may also be formed in a circular shape. The first slot S1 and the second slot S2 may be formed in a circular shape.

Referring to FIG. 6B, the inner patch and the outer patch may be configured as square patches. Therefore, the first patch 1110 may be formed in a square shape and the second patch 1120*b* may also be formed in a square shape. The first slot S1*b* may be formed in a square shape and the second slot S2 may be formed in a circular shape.

Referring to FIG. 6C, the inner patch and the outer patch may be configured as polygonal patches. Therefore, the first patch 1110*c* may be formed in a polygonal shape and the second patch 1120*c* may also be formed in a polygonal shape. The first slot S1*c* may be formed in a polygonal shape and the second slot S2 may be formed in a circular shape.

With respect to a radiation principle of the radiator structures illustrated in FIGS. 5 to 6C, a radio signal of a first band can be radiated by the first patch 1110, 1110*a*, 1110*c*. Specifically, the radio signal of the first band may be radiated by current induced along the inside of the first patch 1110, 1110*a*, 1110*c*. In this regard, a length of a current path P1 through which the radio signal of the first band is induced to be radiated may be set to a quarter-wavelength.

In some examples, radio signals of the second band and the third band may be radiated by the second patch 1120, 1120*b*, 1120*c*. Specifically, the radio signal of the second band may be radiated by current induced inside the second patch 1120, 1120*b*, 1120*c* along the outside of the second slot S2. In addition, the radio signal of the third band may be radiated by current induced along the outside of the second patch 1120, 1120*b*, 1120*c*. In this regard, a length of a current path P2 through which the radio signal of the second band is induced to be radiated may be set to a quarter-wavelength. In some examples, a length of a current path P3 through which the radio signal of the third band is induced to be radiated may be set to a half wavelength.

Referring to FIG. 5, the radio signal of the first band may be radiated by the square patch 1110. Specifically, the radio signal of the first band may be radiated by current induced along the circular slot S1 inside the square patch 1110. In some examples, the radiation may be carried out in the second band through the circular patch 1120 disposed in the first slot S1 inside the square patch 1110. Specifically, the radiation may be carried out in the second band along the outside of the circular patch 1120 disposed in the first slot S1. In addition, the radiation may be carried out in the third band through the first slot S1 between the square patch 1110 and the circular patch 1120. As aforementioned, the second band may be a band higher than the first band and the third band may be set to a band higher than the second band.

Referring to FIGS. 5 to 6C, the first feeding line 1130 may include first conductive patterns 1131*a* and 1131*b* and first coupling lines 1132 and 1133. The first conductive patterns 1131*a* and 1131*b* may be referred to as the signal lines 1131*a* and 1131*b* as described above. In some examples, the first conductive patterns 1131*a* and 1131*b* may be referred to as first and second signal lines 1131*a* and 1131*b*, respectively.

The first conductive patterns 1131*a* and 1131*b* may be disposed at both sides with interposing the dielectric region therebetween. The first coupling lines 1132 and 1133 may extend from end portions of the first conductive patterns 1131*a* and 1131*b* to both sides along (the first region SR1 of) the first slot S1. Accordingly, the first coupling lines 1132 and 1133 may be configured to couple the first signal to the first patch 1110, 1110*a*, 1110*c* and/or the second patch 1120, 1120*b*, 1120*c*. An end portion of one of the first coupling lines 1132 and 1133 may be spaced apart from the connection line 1150 by a predetermined distance.

Referring to FIGS. 5 to 6C, the second feeding line 1140 may include second conductive patterns 1141*a* and 1141*b* and second coupling lines 1142 and 1143. The second conductive patterns 1141*a* and 1141*b* may be referred to as the signal lines 1141*a* and 1141*b* as described above. In some examples, the second conductive patterns 1141*a* and 1141*b* may be referred to as first and second signal lines 1141*a* and 1141*b*, respectively.

The second conductive patterns 1141*a* and 1141*b* may be disposed at both sides with interposing the dielectric region therebetween. The second coupling lines 1142 and 1143 may extend from end portions of the second conductive patterns 1141*a* and 1141*b* to both sides along (the second region SR2 of) the first slot S1. Accordingly, the second coupling lines 1142 and 1143 may be configured to couple the second signal to the first patch 1110, 1110*a*, 1110*c* and/or the second patch 1120, 1120*b*, 1120*c*. An end portion of one of the second coupling lines 1142 and 1143 may be spaced apart from the connection line 1150 by a predetermined distance.

The first coupling lines 1132 and 1133 may include a third signal line 1133 disposed adjacent to the connection line 1150 and a fourth signal line 1132 disposed away from the connection line 1150. In some examples, the second coupling lines 1142 and 1143 may include a third signal line 1143 disposed adjacent to the connection line 1150 and a fourth signal line 1142 disposed away from the connection line 1150. In this regard, the first slot S1 may be defined between the fourth signal line 1132 of the first coupling lines 1132 and 1133 and the fourth signal line 1142 of the second coupling lines 1142 and 1143.

The antenna assembly 1100 may operate as a plurality of antennas by the plurality of feeding lines 1130 and 1140. In this regard, the antenna assembly 1110 may operate as a first antenna ANT1 having a first polarization by a first radio signal applied from the first feeding line 1130. Also, the antenna assembly 1110 may operate as a second antenna ANT2 having a second polarization by a second radio signal applied from the second feeding line 1140. In this regard, the first polarization and the second polarization may be a horizontal polarization and a vertical polarization, but may not be limited thereto, and may alternatively be polarizations with arbitrary angles.

Figure 7A:
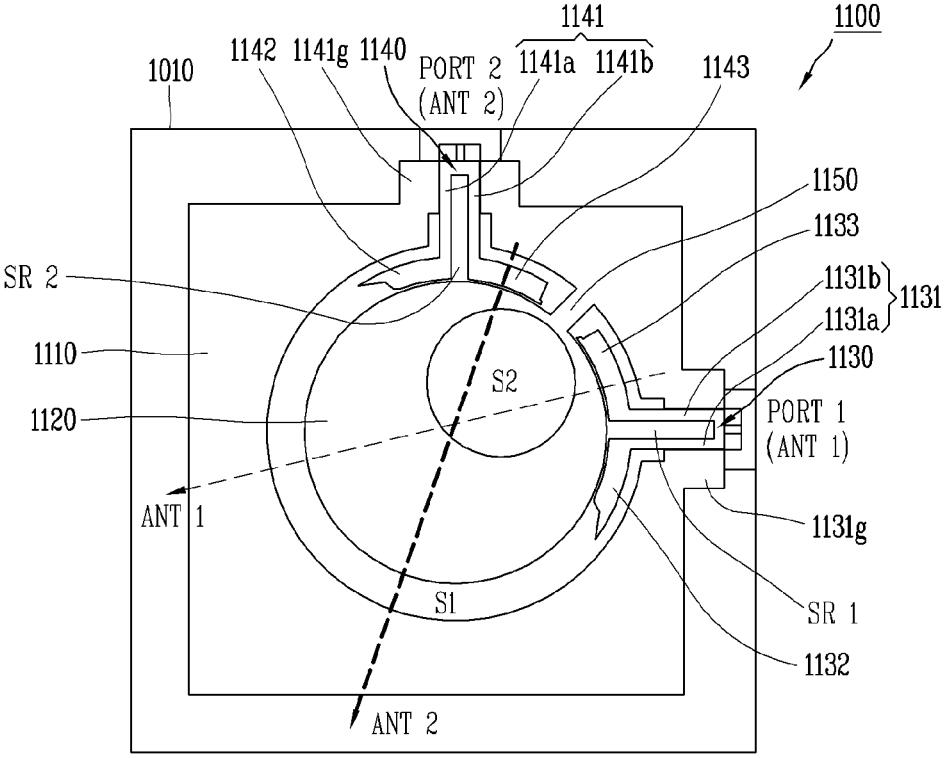
FIG. 7A illustrates first and second polarization directions when power is fed through first and second feeding lines in a radiator structure of FIG. 5.

With respect to the polarization configuration, the first polarization and the second polarization may be configured to be substantially orthogonal to each other, but may not be limited thereto. FIG. 7A illustrates first and second polarization directions when power is fed by first and second feeding lines in the radiator structure of FIG. 5. Referring to FIGS. 5 and 7A, directions in which the first and second feed lines 1130 and 1140 are disposed may be slightly different from the first and second polarization directions. The first polarization direction may be defined in a direction between a first direction in which the first feeding line 1130 is disposed and a third direction in which the connection line 1150 is disposed. The second polarization direction may be defined in a direction between a second direction in which the second feeding line 1140 is disposed and the third direction in which the connection line 1150 is disposed. Accordingly, the first polarization direction and the second polarization direction may not be perpendicular to each other, but may have an angle of about 70 and 80 degrees therebetween.

To reduce correlation between antennas, the antennas may have a polarization difference of about 70 to 80 degrees. A short point may be defined by the connection line 1150 of the second path 1120 corresponding to the circular patch and the circular slot S2. Accordingly, since the first and second patches 1110 and 1120 are connected to the ground by the connection line 1150, the connection line 1150 may also be referred to as a short line 1150. The short point by the short line 1150 may be formed at an angle inclined by about 45 degrees. Accordingly, the first and second polarization directions of the antennas may also be inclined by about 22.5 degrees from the first and second feeding lines 1130 and 1140. In other words, the first polarization direction may be defined between the first feeding line 1130 and the short line 1150. The second polarization direction may be defined between the second feeding line 1140 and the short line 1150. Accordingly, isolation between antennas can be secured by disposing the short line 1150 between the first feeding line 1130 and the second feeding line 1140.

Referring to FIGS. 5 to 7A, the first antenna ANT1 and the second antenna ANT2 may operate as radiators in the first to third bands. As described above, the radio signal of the first band may be radiated by the first patch 1110, 1110*a*, 1110*c*. In some examples, radio signals of the second band and the third band may be radiated by the second patch 1110, 1120*b*, 1120*c*. The radio signal of the second band may be radiated by current induced inside the second patch 1110, 1120*b*, 1120*c* along the outside of the second slot S2. The radio signal of the third band may be radiated by current induced along the inside of the first slot S1 corresponding to the outside of the second patch 1120, 1120*b*, 1120*c*. In this regard, the antenna assembly 1100 may operate as the first antenna ANT1 and the second antenna ANT2 in the third band by the first slot S1 between the fourth signal lines 1132 and 1142.

Figure 7B:
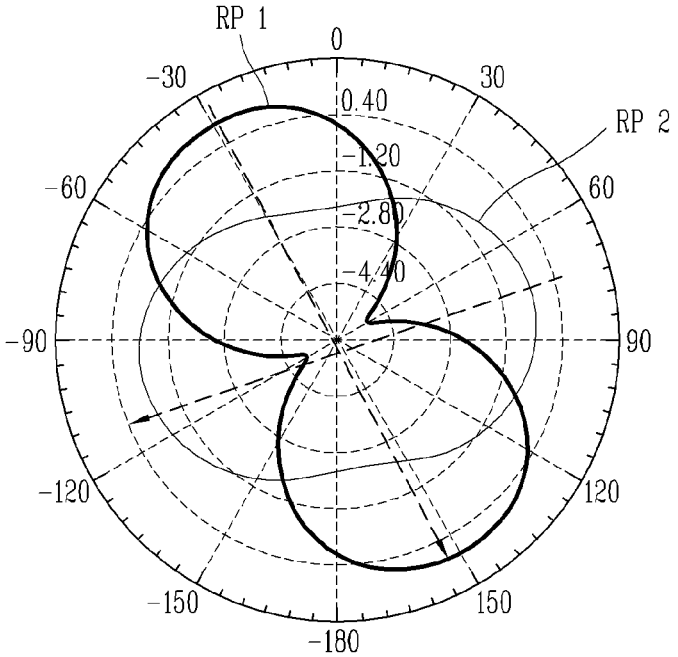
FIG. 7B illustrates a comparison of radiation patterns formed when power is fed through different feeding lines in the antenna structure.
Figure 7B:
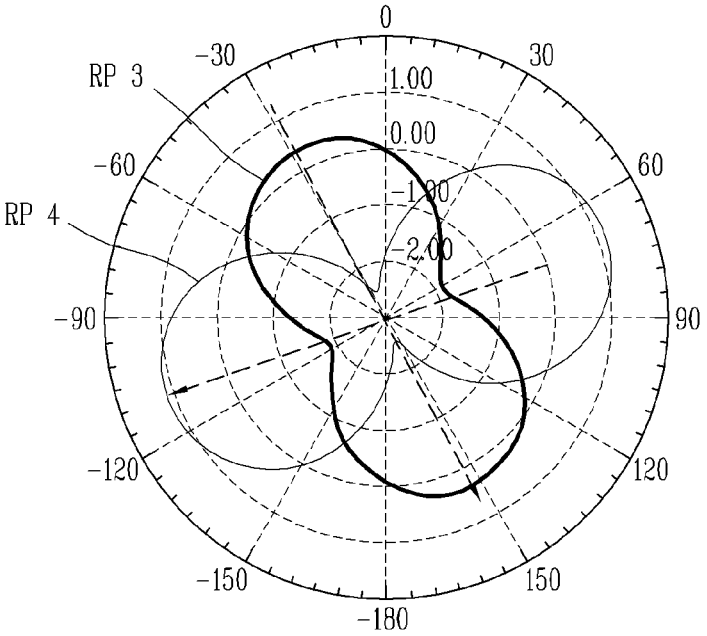

FIG. 7B illustrates a comparison of radiation patterns formed when power is fed through different feeding lines in the antenna structure. (a) of FIG. 7B illustrates a comparison of radiation patterns in the first band and (b) of FIG. 7B illustrates radiation patterns in the second band.

Referring to FIGS. 5 and 7A and (a) of FIG. 7B, when power is fed through the first feeding line 1130 (i.e., PORT1), a radiation pattern RP1 at 1.71 GHz is inclined at a predetermined angle in a vertical direction. In this case, the vertical direction may correspond to a front direction of the dielectric substrate 1010 on which the antennas are disposed, and may be a direction perpendicular to the dielectric substrate 1010. On the other hand, when power is fed through the second feeding line 1140 (i.e., PORT2), a radiation pattern RP2 at 1.71 GHz is inclined at a predetermined angle in a horizontal direction. In this case, the horizontal direction may correspond to a lateral direction of the dielectric substrate 1010 on which the antennas are disposed, and may be a direction horizontal to the dielectric substrate 1010.

Referring to FIGS. 5 and 7A and (b) of FIG. 7B, when power is fed through the first feeding line 1130 (i.e., PORT1), a radiation pattern RP3 at 3.5 GHz is inclined at a predetermined angle in a vertical direction. In this case, the vertical direction may correspond to a front direction of the dielectric substrate 1010 on which the antennas are disposed, and may be a direction perpendicular to the dielectric substrate 1010. On the other hand, when power is fed through the second feeding line 1140 (i.e., PORT2), a radiation pattern RP4 at 3.5 GHz is inclined at a predetermined angle in a horizontal direction. In this case, the horizontal direction may correspond to a lateral direction of the dielectric substrate 1010 on which the antennas are disposed, and may be a direction horizontal to the dielectric substrate 1010. When power is fed through the second feeding line 1140 (i.e., PORT2), the radiation pattern at 3.5 GHz may be different from the radiation pattern at 1.71 GHz in that a null is formed. Accordingly, an interference level between the first antenna ANT1 and the second antenna ANT2 can be more reduced in the second band than in the first band.

Hereinafter, the operating principle of the antenna radiating in the first band to the third band will be described in terms of an electrical field distribution. FIGS. 8A to 8D illustrate a comparison of electric field distributions induced on an antenna surface when signals are applied from the first and second feeding lines for different frequencies.

Figure 8A:
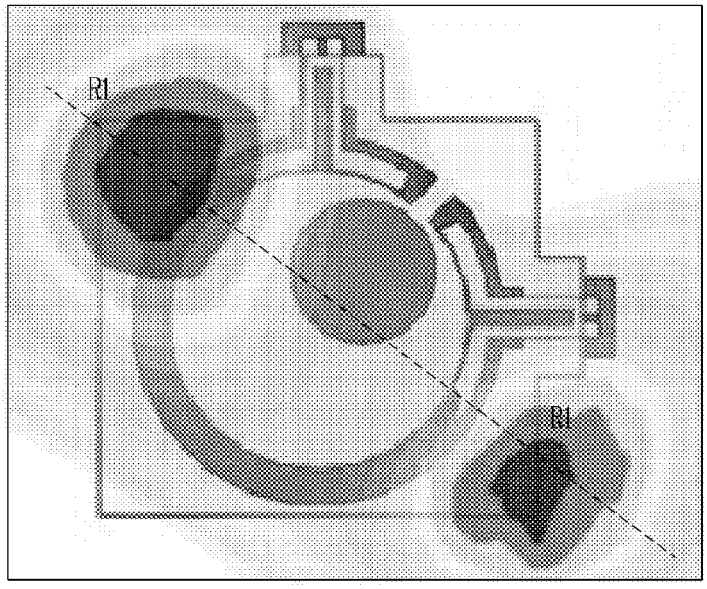
FIGS. 8A to 8D illustrate a comparison of electric field distributions induced on an antenna surface when signals are applied from first and second feeding lines for different frequencies.
Figure 8A:
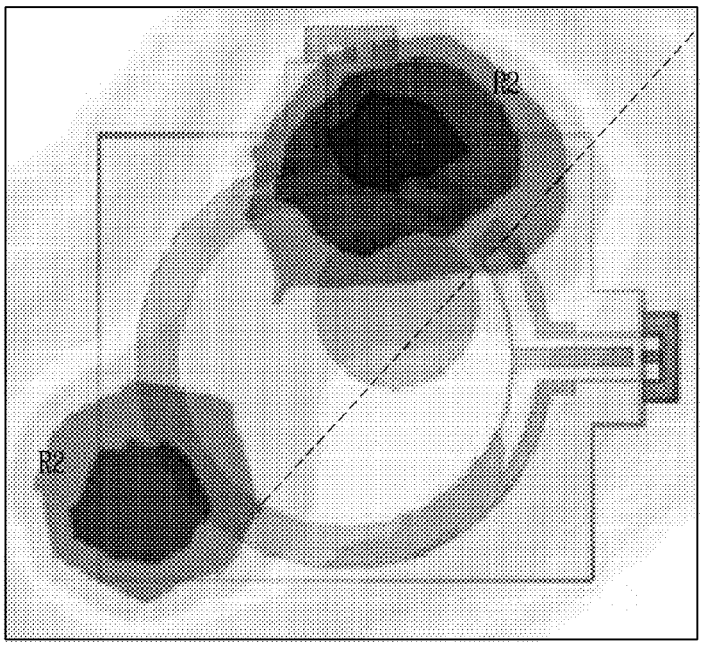

(a) of FIG. 8A illustrates distribution of an electric field induced in the antenna when power is fed through the first feeding line PORT1 at 1.7 GHz corresponding to the first band. A higher electric field distribution is observed in a first region R1 disposed along a first axial direction than in other regions. In this regard, the first axial direction corresponding to the first region R1, which is the maximum electric field distribution region, may be a direction rotated by a predetermined angle from a feeding direction of the first feeding line PORT1.

(b) of FIG. 8A illustrates distribution of an electric field induced in the antenna when power is fed through the first feeding line PORT2 at 1.7 GHz corresponding to the first band. A higher electric field distribution is observed in a second region R2 disposed along a second axial direction than in other regions. In this regard, the second axial direction corresponding to the second region R2, which is the maximum electric field distribution region, may be a direction rotated by a predetermined angle from a feeding direction of the second feeding line PORT2. In some examples, the second axial direction corresponding to the second region R2 may be formed substantially perpendicular to the first axial direction corresponding to the first region R1.

Figure 8B:
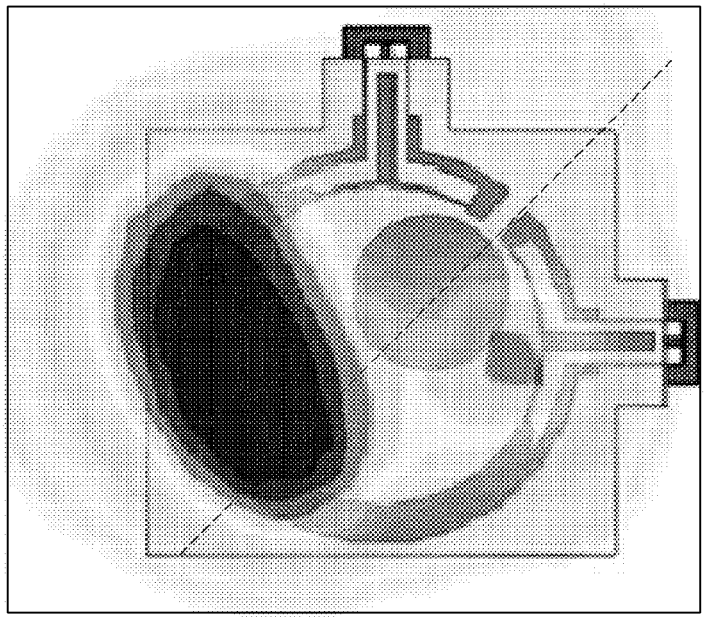
Figure 8B:
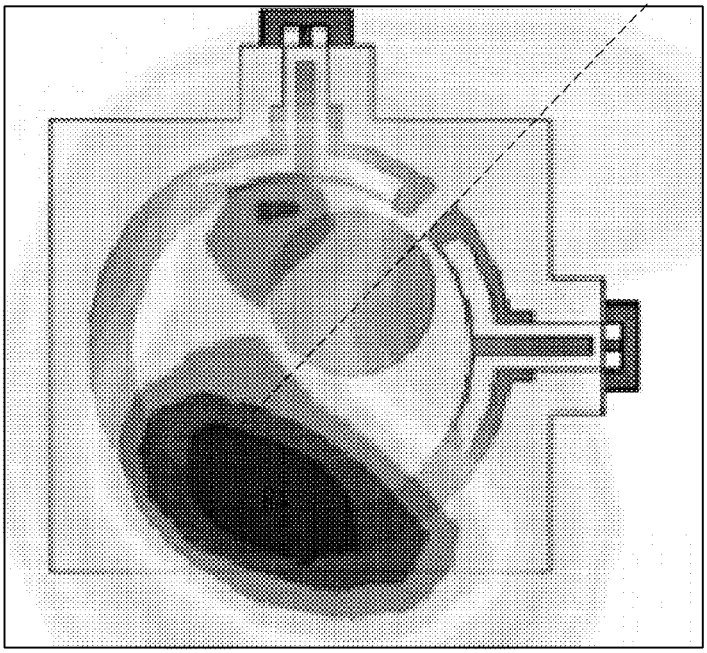
Figure 8C:
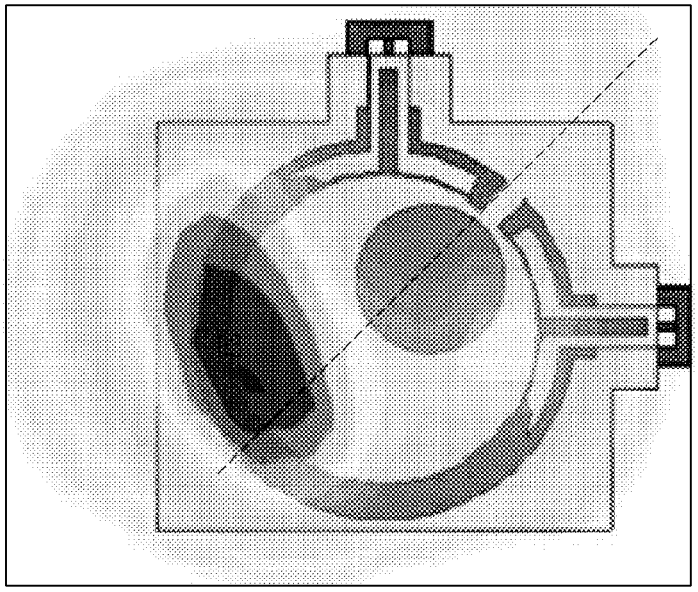
Figure 8C:
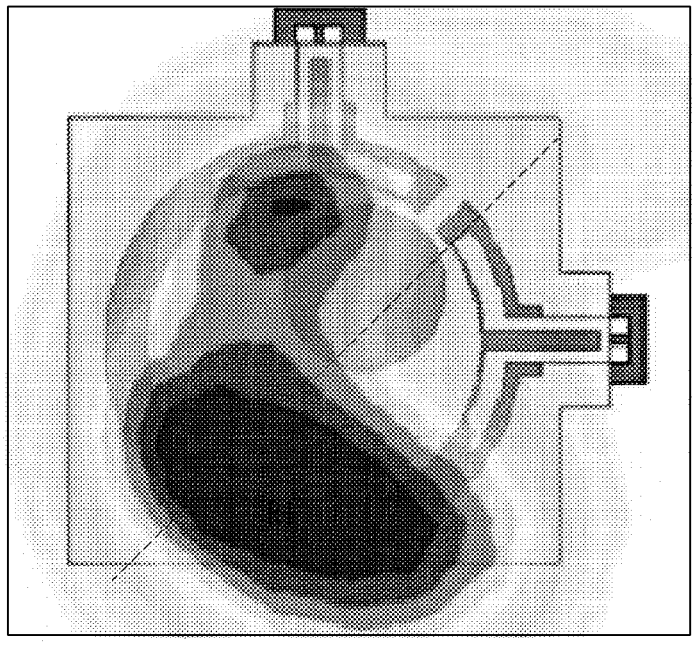

(a) of FIG. 8B illustrates distribution of an electric field induced in the antenna when power is fed through the first feeding line PORT1 at 2.5 GHz corresponding to the second band. (a) of FIG. 8C illustrates distribution of an electric field induced in the antenna when power is fed through the first feeding line PORT1 at 3.4 GHz corresponding to the second band. A higher electric field distribution is observed in a third region R3 disposed along a second axial direction than in other regions. In this regard, the second axial direction corresponding to the third region R3, which is the maximum electric field distribution region, may be a direction rotated by a predetermined angle from the feeding direction in the first feeding line PORT1.

In some examples, although there are some differences in the electric field distributions at 2.5 GHz and 3.4 GHz in the second band, the maximum electric field distribution region may be commonly the third region R3. Accordingly, as illustrated in FIG. 5, the second patch 1120 may operate as a radiator in the second band by the current induced inside the second patch 1120 along the outside of the circular slot S2. Therefore, as illustrated in (a) of FIG. 8B and (a) of FIG. 8C, the maximum electric field distribution region may commonly be the third region R3 and the second path 1120 can operate as an antenna according to a similar radiation mechanism in the full second band.

(b) of FIG. 8B illustrates distribution of an electric field induced in the antenna when power is fed through the second feeding line PORT2 at 2.5 GHz corresponding to the second band. (b) of FIG. 8C illustrates distribution of an electric field induced in the antenna when power is fed through the second feeding line PORT2 at 3.4 GHz corresponding to the second band. A higher electric field distribution is observed in a fourth region R4 disposed along the second axial direction than in other regions. In this regard, the second axial direction corresponding to the second region R4, which is the maximum electric field distribution region, may be a direction rotated by a predetermined angle from the feeding direction of the second feeding line PORT2. In some examples, the fourth region R4 may be a region symmetrical to the third region R3 with respect to the second axial direction. The third region R3 may be an upper region with respect to the second axial direction and the fourth region R4 may be a lower region with respect to the second axial direction.

In some examples, although there are some differences in the electric field distributions at 2.5 GHz and 3.4 GHz in the second band, the maximum electric field distribution region may be commonly the fourth region R4. Accordingly, as illustrated in FIG. 5, the second patch 1120 may operate as a radiator in the second band by the current induced inside the second patch 1120 along the outside of the circular slot S2. Therefore, as illustrated in (b) of FIG. 8B and (b) of FIG. 8C, the maximum electric field distribution region may commonly be the fourth region R4 and the second path 1120 can operate as an antenna according to a similar radiation mechanism in the full second band.

Figure 8D:
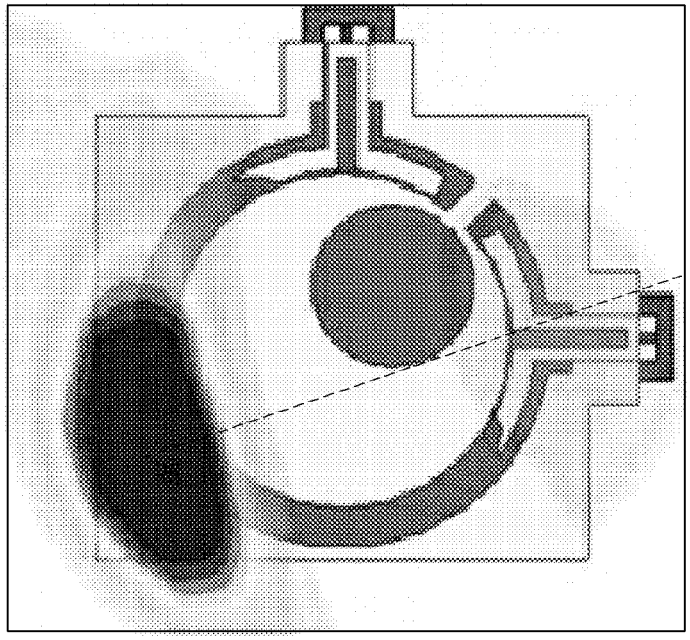
Figure 8D:
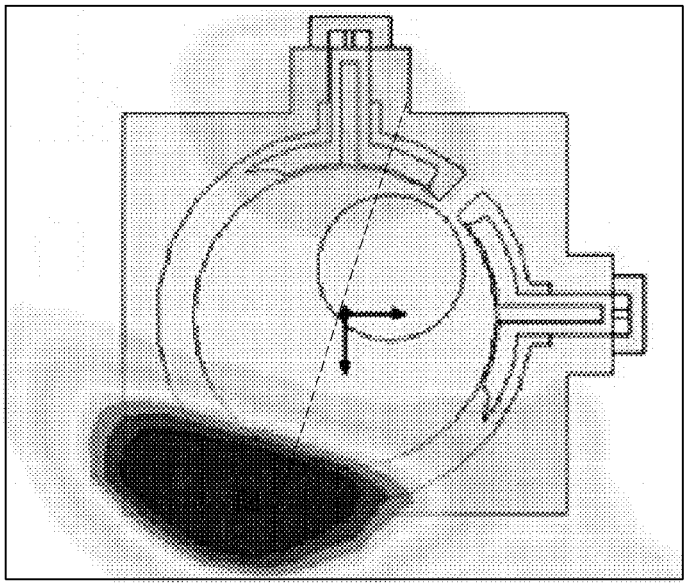

(a) of FIG. 8D illustrates distribution of an electric field induced in the antenna when power is fed through the first feeding line PORT1 at 6.0 GHz corresponding to the third band. A higher electric field distribution is observed in a fifth region R5 disposed along a third axial direction than in other regions. In this regard, the third axial direction corresponding to the fifth region R5, which is the maximum electric field distribution region, may be a direction rotated by a predetermined angle from the feeding direction in the first feeding line PORT1.

(b) of FIG. 8D illustrates distribution of an electric field induced in the antenna when power is fed through the second feeding line PORT2 at 6.0 GHz corresponding to the third band. A higher electric field distribution is observed in a sixth region R6 disposed along a fourth axial direction than in other regions. In this regard, the fourth axial direction corresponding to the sixth region R6, which is the maximum electric field distribution region, may be a direction rotated by a predetermined angle from the feeding direction in the second feeding line PORT2. In some examples, the fourth axial direction corresponding to the sixth region R6 may be formed substantially perpendicular to the third axial direction corresponding to the fifth region R5.

Figure 9A:
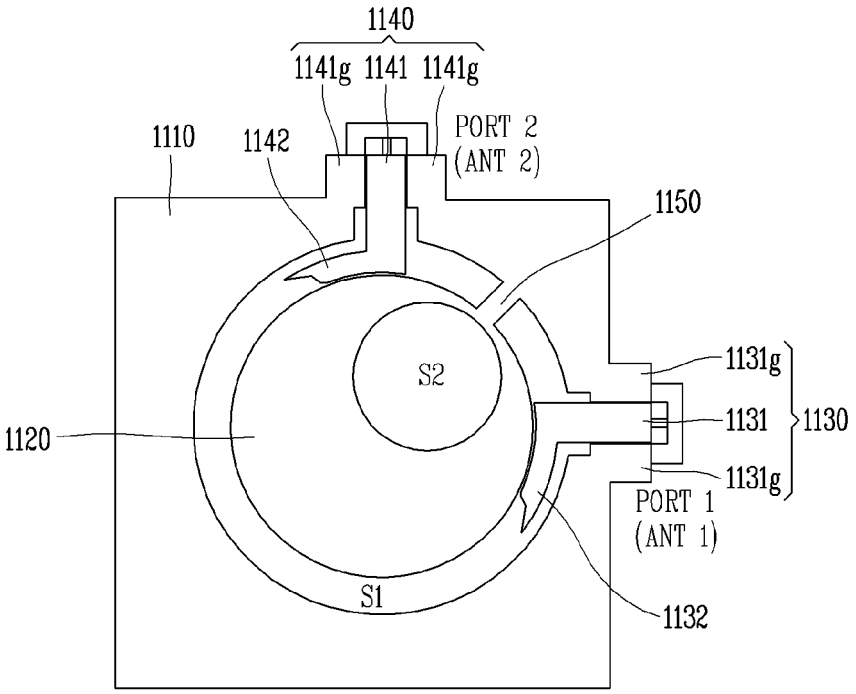
FIGS. 9A and 9B illustrate a comparison of antenna structures having different coupling lines.
Figure 9B:
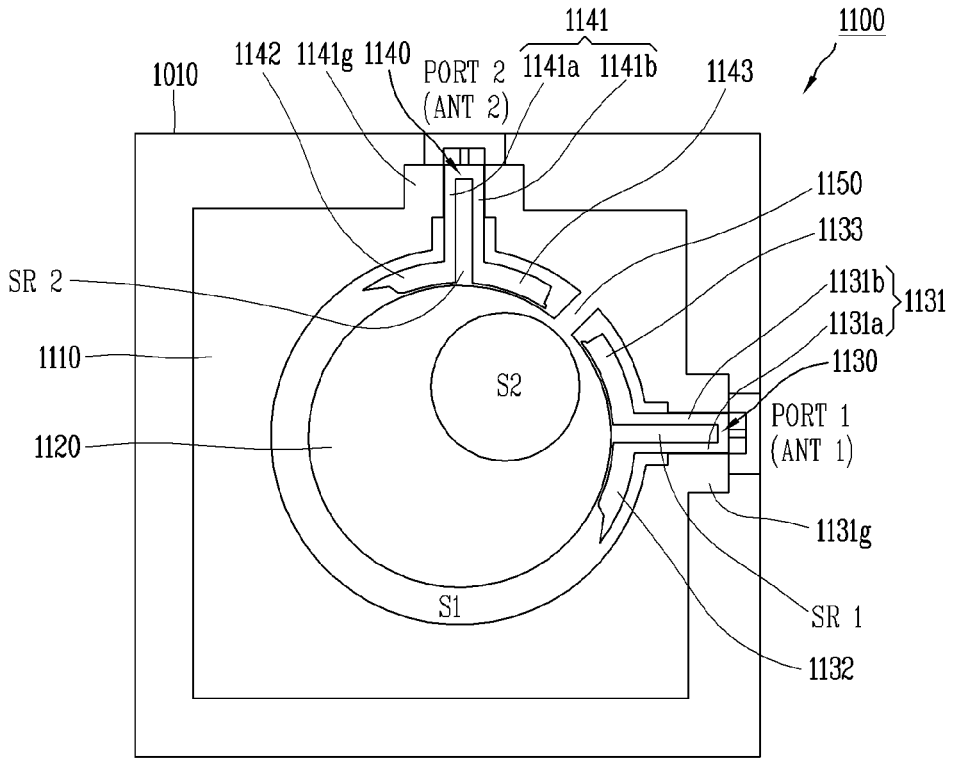

The wideband dual-polarized antenna structure may employ a branched coupling feed structure so as to operate as a wideband antenna. FIGS. 9A and 9B illustrate a comparison of antenna structures having different coupling lines. Referring to FIG. 9A, the first coupling line 1132 and the second coupling line 1142 may extend to only one side from the signal lines 1131 and 1141. Accordingly, end portions of the first coupling line 1132 and the second coupling line 1142 may be tapered to have reduced widths and implemented as a high impedance structure.

Referring to FIGS. 5 and 9B, the first coupling lines 1132 and 1133 and the second coupling lines 1142 and 1143 may extend to both sides from the signal lines 1131 and 1141. An end portion of one (i.e., 1132) of the first coupling lines 1132 and 1133 and an end portion of one (i.e., 1142) of the second coupling lines 1142 and 1143 may be tapered to have reduced widths and implemented as a high impedance structure. In addition, the other (i.e., 1133) of the first coupling lines 1132 and 1133 and the other (i.e., 1143) of the second coupling lines 1142 and 1143 may be disposed adjacent to the short line 1150. Accordingly, the other of the first coupling lines 1132 and 1133 and the other of the second coupling lines 1142 and 1143 may be implemented as a low impedance structure.

Figure 10:
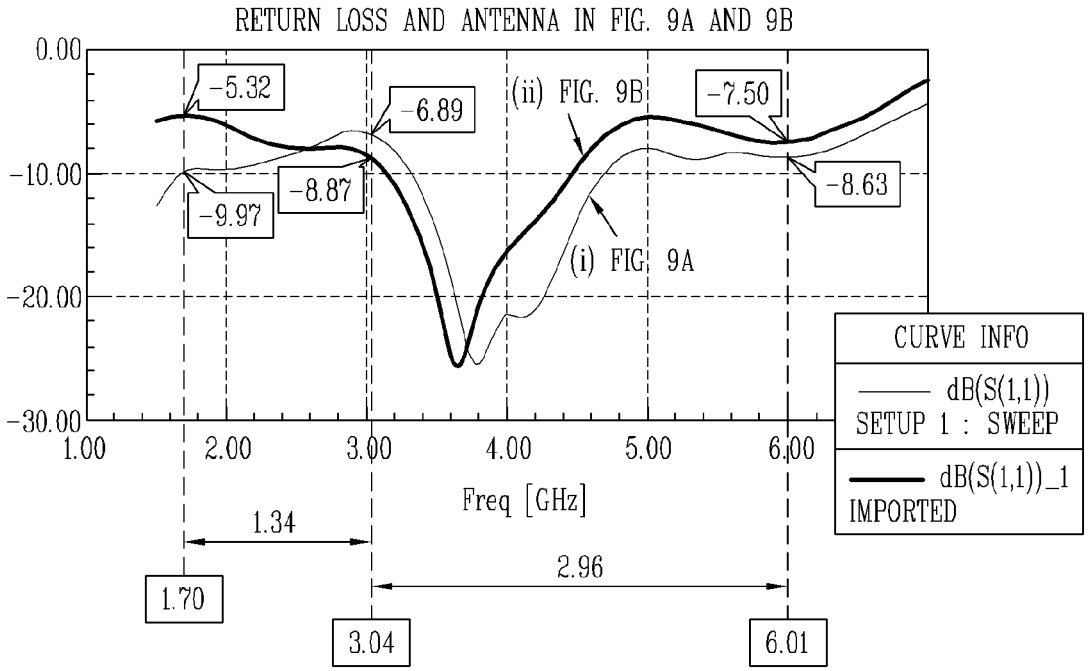
FIG. 10 illustrates a comparison of return loss results according to the dual-feeding antenna structures of FIGS. 9A and 9B.

Therefore, the branched coupling feed structure implemented by the first coupling lines 1132 and 1133 and the second coupling lines 1142 and 1143 can have the high impedance structure and the low impedance structure based on the short line 1150. The branched coupling feed structure can simultaneously feed a portion with high impedance and a portion with low impedance based on the short line 1150, thereby extending an antenna bandwidth. FIG. 10 illustrates a comparison of return loss results according to the dual-feeding antenna structures of FIGS. 9A and 9B.

Referring to FIGS. 9A and 10, the antenna having the single coupling feed structure (i) may operate in the second band and the third band. Therefore, the bandwidth of the antenna having the single coupling feeding structure (i) can cover the second band and the third band. On the other hand, referring to FIGS. 5, 9B, and 10, the antenna having the branched coupling feed structure (ii) with the first coupling lines 1132 and 1133 and the second coupling lines 1142 and 1143 may operate even in the first band as well as the second band and the third band. Therefore, the bandwidth of the antenna having the branched coupling feed structure (ii) can cover the first to third bands. Accordingly, the bandwidth of the antenna having the branched coupling feed structure can be improved by about 15% or more, compared to the bandwidth of the antenna having the single coupling feed structure (i).

Figure 11A:
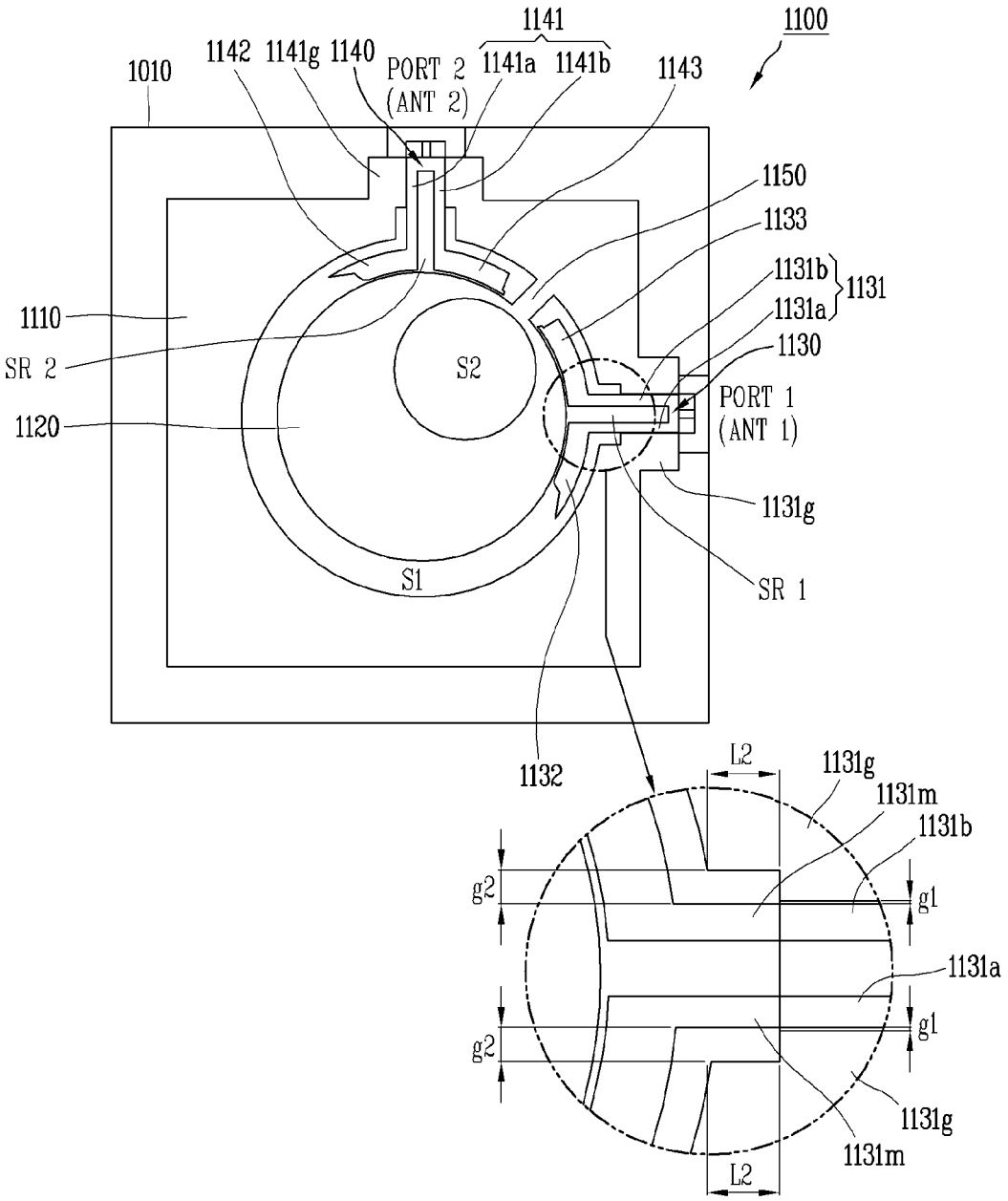
FIGS. 11A and 11B illustrate a stepped CPW feeding structure in accordance with an example.
Figure 11B:
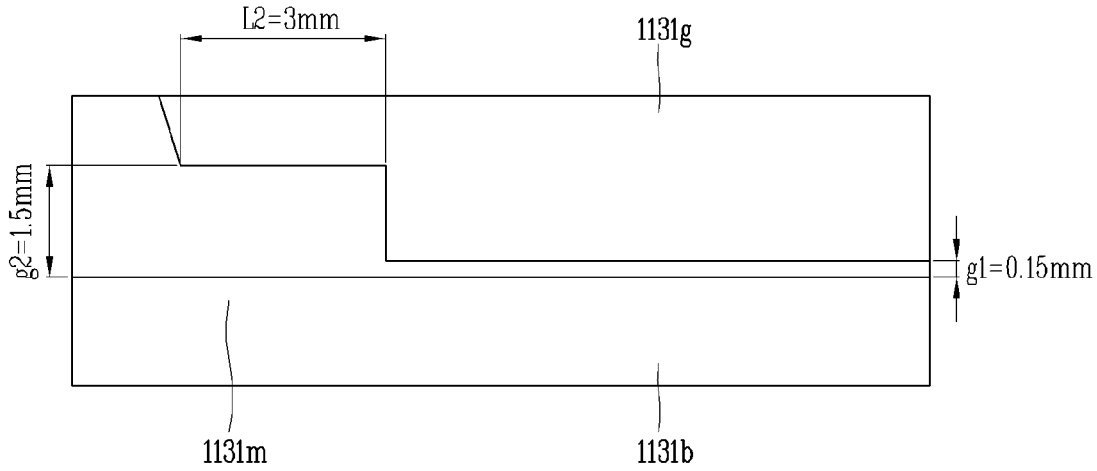

The feeding structure of the wideband antenna may be implemented as a wideband feed structure. FIGS. 11A and 11B illustrate a stepped CPW feed structure in accordance with an example. FIG. 11A is an enlarged view illustrating a wideband CPW feed structure in the antenna structure of FIG. 5. The wideband CPW feed structure may be implemented as a stepped CPW feed structure in which a distance between the signal line 1131 and the ground pattern 1131*g* is changed. FIG. 11B illustrates a gap between the signal line and the ground pattern in the stepped CPW feed structure of FIG. 11A.

Referring to FIGS. 5, 11A, and 11B, first ground patterns 1131*g* may be disposed adjacent to the first conductive patterns 1131*a* and 1131*b*. Also, the second ground patterns 1141*g* may be disposed adjacent to the second conductive patterns 1141*a* and 1141*b*.

In some examples, distances between the first ground patterns 1131*g* and the first conductive patterns 1131*a* and 1131*b* may increase from a first gap g1 to a second gap g2. In other words, the distances between the first ground patterns 1131*g* and the first conductive patterns 1131*a* and 1131*b* may increase from the first gap g1 to the second gap g2 as being adjacent to the first slot S1 having the circular shape. Accordingly, a width of the dielectric region corresponding to an impedance matching unit 1131*m* may be set to the second gap g2. Also, a length of the dielectric region corresponding to the impedance matching unit 1131*m* may be set to a second length L2.

Similarly, distances between the second ground patterns 1141*g* and the second conductive patterns 1141*a* and 1141*b* may increase from the first gap g1 to the second gap g2. In other words, the distances between the second ground patterns 1141*g* and the second conductive patterns 1141*a* and 1141*b* may increase from the first gap g1 to the second gap g2 as being adjacent to the first slot S1 having the circular shape. Accordingly, a width of the dielectric region corresponding to the impedance matching unit 1131*m* may be set to the second gap g2. Also, a length of the dielectric region corresponding to the impedance matching unit 1131*m* may be set to a second length L2. For example, the first gap g1 may be set to 0.15 mm and the second gap g2 may be set to 1.5 mm, but may not be limited thereto. Also, the second length L2 may be set to about 3.0 mm, but may not be limited thereto.

Figure 12:
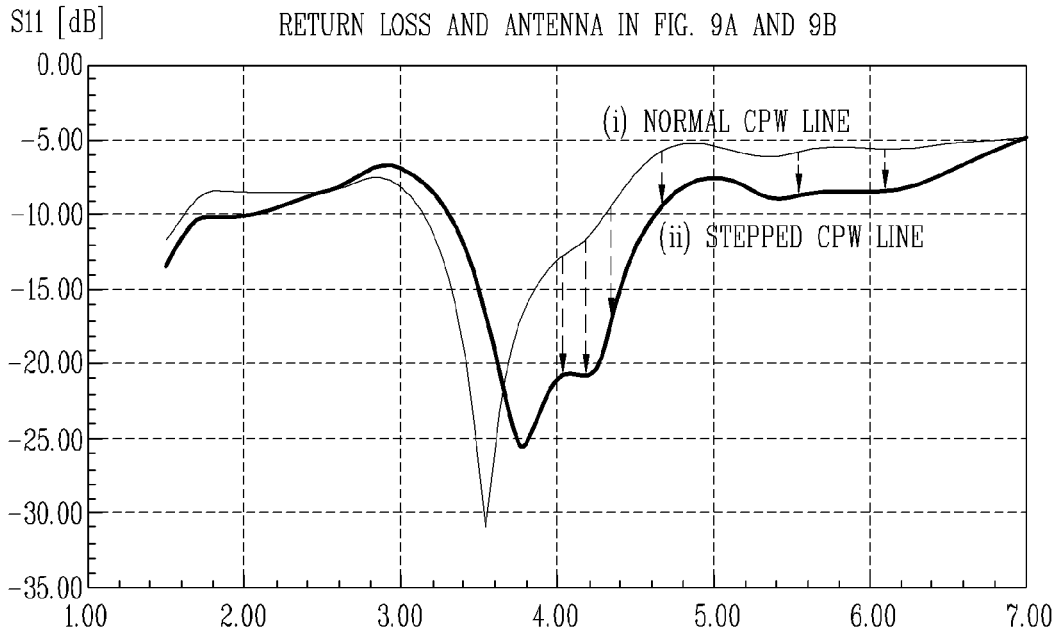
FIG. 12 illustrates a comparison of return loss results according to a normal CPW feeding structure and a stepped CPW feeding structure in the antennas of FIGS. 5, 11A, and 11B.

Therefore, a gap region having a stepped structure can be implemented between the CPW signal lines 1131*a*, 1131*b*, 1141*a*, and 1141*b* and the ground patterns 1131*g* and 1141*g* in the second band and the third band. FIG. 12 illustrates a comparison of return loss results according to a normal CPW feed structure and a stepped CPW feed structure in the antennas of FIGS. 5, 11A, and 11B. Referring to FIG. 12, when applying the normal CPW feed structure (i) with a constant gap between a signal line and a ground pattern, a return loss characteristic is lowered at 4 to 6 GHz. On the other hand, when applying the stepped CPW feed structure (ii) in which the gap between the signal line and the ground pattern increases from the first gap g1 to the second gap g2, the return loss characteristic can be improved at 4 to 6 GHz. Specifically, when a constant gap of 0.15 mm is applied, S11 is improved from about −5 dB to about −8 dB when the gap is increased from 0.15 mm to 1.5 mm.

Figure 13A:
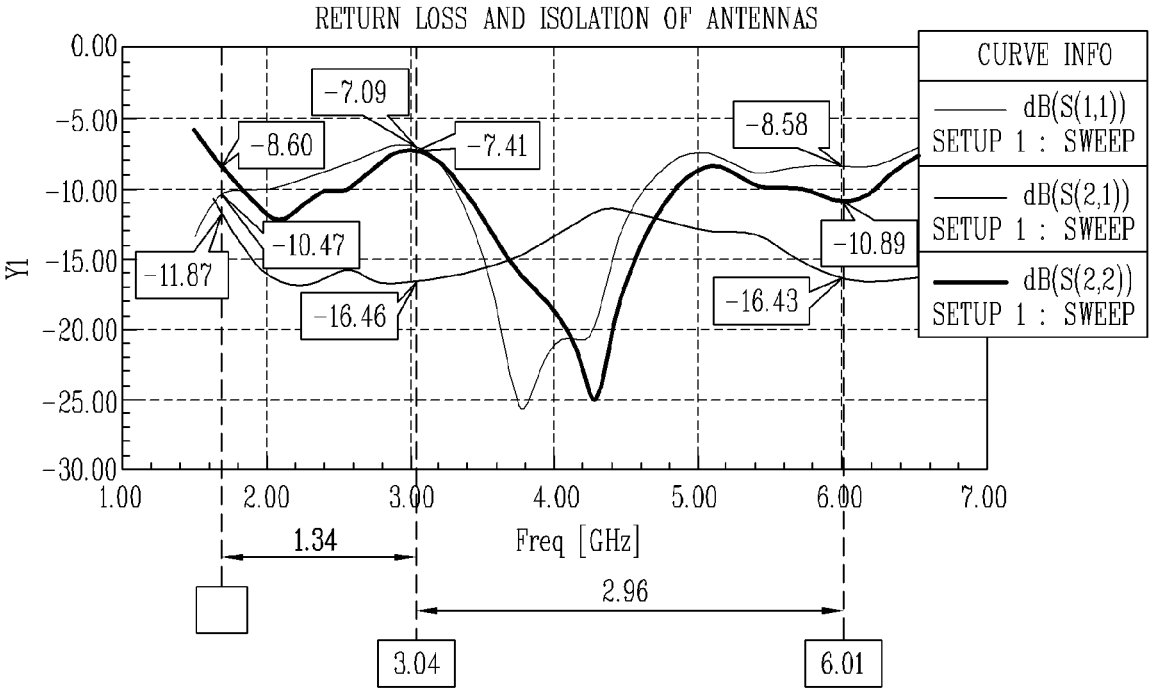
FIGS. 13A and 13B illustrate antenna performance of a wideband dual-polarized antenna structure in accordance with an example.
Figure 13B:
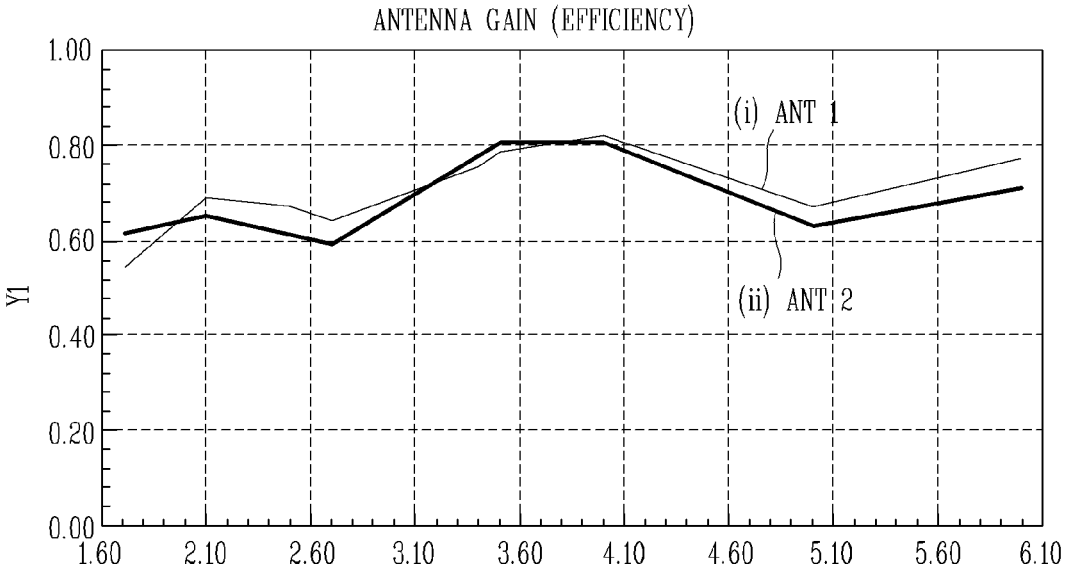

Hereinafter, the antenna performance of the wideband dual-polarized antenna structure will be described. FIGS. 13A and 13B illustrate antenna performance of a wideband dual-polarized antenna structure in accordance with an example. FIG. 13A illustrates return loss and isolation of the wideband dual-polarized antenna structure. In addition, FIG. 13B illustrates an antenna gain of the wideband dual-polarized antenna structure.

Referring to FIGS. 5, 9, 11A, and 13A, the first antenna ANT1 having the structure (i) fed through the first feeding line 1130 has a return loss value of −7 dB or less in the full band. The second antenna ANT2 having the structure (ii) fed through the second feeding line 1140 also has the return loss value of −7 dB or less in the full band. In this regard, the full band may include the first band to the third band. On the other hand, isolation between the first antenna ANT and the second antenna ANT2 (iii) is 12 dB or more in the full band. Accordingly, the wideband dual-polarized antenna structure can normally operate as a plurality of radiators in the full band including the first to third bands, and an interference level between the radiators can be maintained below a predetermined level.

Referring to FIGS. 5, 9, 11A, and 13B, the first antenna ANT1 having the structure (i) fed through the first feeding line 1130 has a gain value of −3 dBi or more. The second antenna ANT2 having the structure (ii) fed through the second feeding line 1140 also has the gain value of −3 dBi or more.

Figure 14:
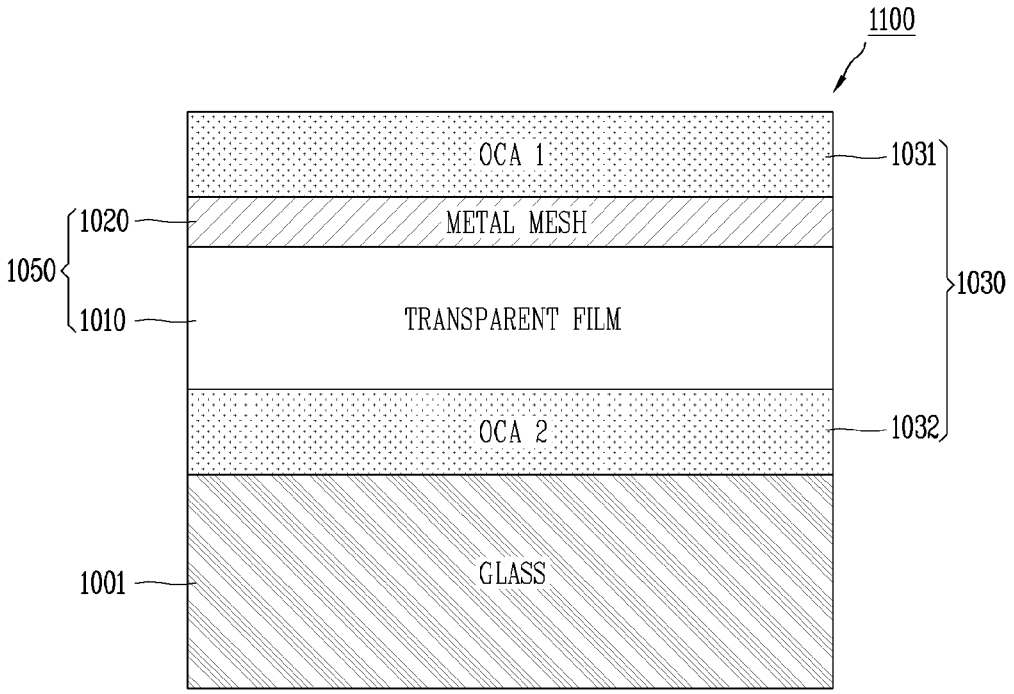
FIG. 14 illustrates a layered structure of an antenna assembly in which a transparent antenna implemented in the form of a metal mesh is disposed on glass and a mesh grid structure.
Figure 14:
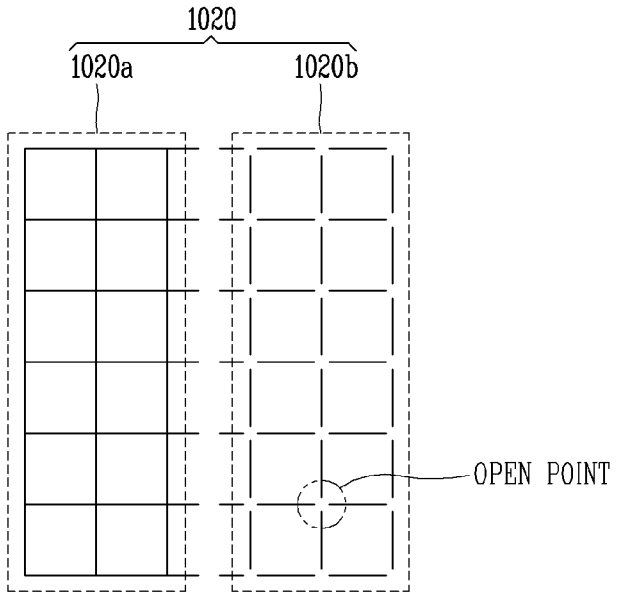

In some examples, the wideband dual-polarized antenna structure may be implemented as a transparent antenna in the form of a metal mesh on glass or a display. FIG. 14 illustrates a layered structure of an antenna assembly in which a transparent antenna implemented in the form of a metal mesh is disposed on glass and a mesh grid structure.

Referring to (a) of FIG. 14, the layered structure of an antenna assembly on which the transparent antenna is disposed may include glass 1001, a dielectric substrate 1010, a metal mesh layer 1020, and an optical clear adhesive (OCA) layer 1030. The dielectric substrate 1010 may be implemented as a transparent film. The OCA layer 1030 may include a first OCA layer 1031 and a second OCA layer 1032.

The glass 1001 may be made of a glass material, and the second OCA layer 1032 serving as a glass attachment sheet may be attached to the glass 1001. As one example, the glass 1001 may have a thickness of about 3.5 to 5.0 mm, but may not be limited thereto. The glass 1001 may constitute the front window 301 of the vehicle illustrated in FIGS. 1A and 1B.

The dielectric substrate 1010 made of the transparent film material may constitute a dielectric region at which conductive patterns of the upper metal mesh layer 1020 are disposed. The dielectric substrate 1010 may have a thickness of about 100 to 150 mm, but may not be limited thereto.

The metal mesh layer 1020 may be formed by the plurality of metal mesh grids as illustrated in FIG. 5 and (b) of FIG. 14. Conductive patterns may be configured such that the plurality of metal mesh grids operate as feeding lines or radiators. The metal mesh layer 1020 may constitute a transparent antenna region. As one example, the metal mesh layer 1020 may have a thickness of about 2 mm, but may not be limited thereto.

The metal mesh layer 1020 may include a metal mesh grid 1020*a* and a dummy mesh grid 1020*b*. In some examples, the first OCA layer 1031 serving as a transparent film layer for protecting the conductive patterns from an external environment may be disposed on upper regions of the metal mesh grid 1020*a* and the dummy mesh grid 1020*b*.

The first OCA layer 1031 may be a protective sheet of the metal mesh layer 1020 and may be disposed on the upper region of the metal mesh layer 1020. As one example, the first OCA layer 1031 may have a thickness of about 20 to 40 mm, but may not be limited thereto. The second OCA layer 1032 may be the glass attachment sheet and may be disposed on the upper region of the glass 1001. The second OCA layer 1032 may be disposed between the glass 1001 and the dielectric substrate 1010 made of the transparent film material. As one example, the second OCA layer 1032 may have a thickness of about 20 to 50 mm, but may not be limited thereto.

Referring to FIG. 5 and (b) of FIG. 14, the antenna assembly 1100 may be implemented as a transparent antenna. To this end, the first conductive patterns of the first patch 1110, 1110*a*, 1110*c* and the second conductive patterns of the second patch 1120, 1120*b*, 1120*c* may be configured as a metal mesh pattern 1020 with a plurality of grids electrically connected together. Accordingly, the antenna assembly 1100 including the first patch 1110, 1110*a*, 1110*c* and the second patch 1120, 1120*b*, 1120*c* may be implemented as a metal mesh grid 1020*a* such that the plurality of grids are interconnected. On the other hand, the dummy mesh grid 1020*b* disposed at the dielectric region may be implemented as an open dummy pattern in which a plurality of grids are disconnected at connection points.

Accordingly, the transparent antenna region may be divided into an antenna pattern region and an open dummy region. The antenna pattern region may be defined by the metal mesh grid 1020*a* in which the plurality of grids are connected to one another. On the other hand, the open dummy region may be defined by the dummy mesh grid 1020*b* having an open dummy structure disconnected at the connection points.

The foregoing description has been given of the wideband antenna assembly implemented as the transparent antenna according to one aspect. Hereinafter, an antenna system for a vehicle having an antenna assembly according to another aspect will be described. An antenna assembly attached to the vehicle glass may be implemented as a transparent antenna.

Figure 15A:
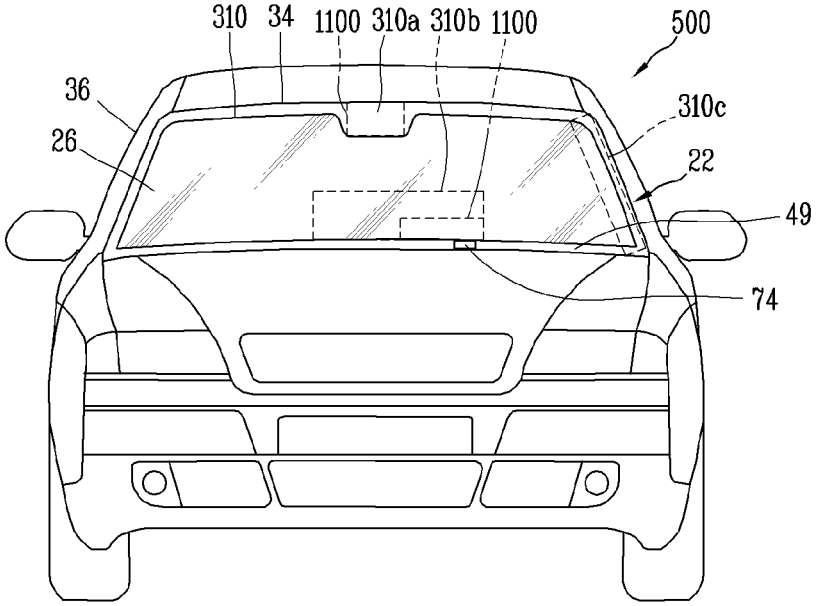
FIG. 15A is a front view of a vehicle in which a transparent antenna can be implemented on glass.
Figure 15B:
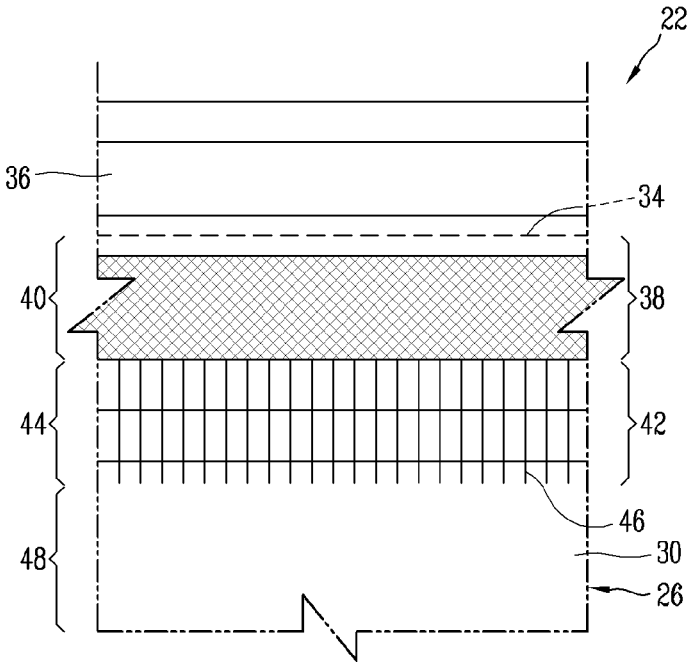
FIG. 15B illustrates a detailed configuration of a transparent glass assembly, in which a transparent antenna can be implemented.

FIG. 15A is a front view of a vehicle in which a transparent antenna can be implemented on glass. FIG. 15B illustrates a detailed configuration of a transparent glass assembly, in which a transparent antenna can be implemented.

Referring to FIG. 15A which is the front view of the vehicle 500, a configuration in which the transparent antenna for the vehicle can be disposed is illustrated. A pane assembly 22 may include an antenna disposed on an upper region 310*a*. Additionally, the pane assembly 22 may include a translucent pane glass 26 formed of a dielectric substrate. The antenna of the upper region 310*a* may support any one or more of a variety of communication systems.

The antenna disposed on the upper region 310*a* of the front window 310 of the vehicle may operate in a mid band MB, a high band HB, and a 5G Sub 6 band of 4G/5G communication systems. The front window 310 of the vehicle may be formed of the translucent pane glass 26. The translucent pane glass 26 may include a first part 38 at which the antenna and a portion of a feeder are formed, and a second part 42 at which another portion of the feeder and a dummy structure are formed. The translucent pane glass 26 may further include external regions 30 and 36 at which conductive patterns are not formed. For example, the outer region 30 of the translucent pane glass 26 may be a transparent region 48 formed to be transparent to secure light transmission and a field of view.

Although it is exemplarily illustrated that the conductive patterns can be formed at a partial region of the front window 310, another example may illustrate that the conductive patterns extend to the side glass 320 of FIG. 1B, the rear glass 330 of FIG. 3C, and an arbitrary glass structure. An occupant or driver in the vehicle 20 can see roads and surrounding environments through the translucent pane glass 26 generally without obstruction by the antenna disposed at the upper region 310*a*.

Referring to FIGS. 15A and 15B, the antenna disposed at the upper region 310*a* may include a first part 38 corresponding to an entire first region 40 of the translucent pane glass 26, and a second part 42 corresponding to an entire second region 44 of the translucent pane glass 26 located adjacent to the first region 40. The first part 38 may have a greater density (i.e., a larger grid structure) than the second part 42. Because the density of the first part 38 is greater than the density of the second part 42, the first part 38 may be perceived to be more transparent than the second part 42. Also, antenna efficiency of the first part 38 may be higher than antenna efficiency of the second part 42.

Accordingly, it may also be configured such that an antenna radiator is disposed at the first part 38 and a dummy radiator (dummy portion) is disposed at the second part 42. When the antenna assembly 1100 is implemented at the first part 38 that is the upper region 310*a* of the front glass 310 of the vehicle, the dummy radiator or a portion of the feeding line may be disposed at (attached to) the second part 42.

In this regard, the antenna region may be implemented at the upper region 310*a* of the front glass 310 of the vehicle. The conductive patterns in the form of the metal mesh grid constituting the antenna may be disposed at the first part 38. In some examples, a dummy mesh grid may be disposed at the first part 38 for visibility. In addition, in view of maintaining transparency between the first part 38 and the second part 42, conductive patterns in the form of the dummy mesh grid may also be disposed at the second part 42. An interval between mesh grids 46 disposed at the second part 42 may be wider than an interval between mesh grids disposed at the first part 38.

Conductive mesh grids disposed at the first part 38 of the antenna disposed at the upper region 310*a* may extend up to a region including a peripheral part 34 and the second part 42 of the translucent pane glass 26. The antenna of the upper region 310*a* may extend in one direction along the peripheral part 34.

The antenna assembly 1100 such as the transparent antenna may be disposed at the upper region 310*a* of the front glass 310 of the vehicle, but may not be limited thereto. When the antenna assembly 1100 is disposed at the upper region 310*a* of the front glass 310, the antenna assembly 1100 may extend up to an upper region 38 of the translucent pane glass 26. The upper region 38 of the translucent pane glass 26 may have lower transparency than other portions. A part of the feeder and other interface lines may be disposed at the upper region 38 of the translucent pane glass 26. When the antenna assembly 1100 is disposed at the upper region 310*a* of the front glass 310 of the vehicle, the antenna assembly 1100 may cooperate with the second antenna system 1000*b* of FIGS. 3A to 3C.

The antenna assembly 1100 may be disposed at the lower region 310*b* or the side region 310*c* of the front glass 310 of the vehicle. When the antenna assembly 1100 is disposed at the lower region 310*b* of the front glass 310 of the vehicle, the antenna assembly 1100 may extend up to a lower region 49 of the translucent pane glass 26. The lower region 49 of the translucent pane glass 26 may have lower transparency than other portions. A part of the feeder and other interface lines may be disposed at the lower region 49 of the translucent pane glass 26. A connector assembly 74 may be disposed at the lower region 49 of the translucent pane glass 26.

When the antenna assembly 1100 is disposed at the lower region 310*b* or the side region 310*c* of the front glass 310 of the vehicle, the antenna assembly 1100 may cooperate with the internal antenna system 1000 of the vehicle illustrated in FIGS. 3A to 3C. However, the cooperation configuration between the antenna system 1000 and the second antenna system 1000*b* may not be limited thereto and may vary depending on applications. In some examples, the antenna assembly 1100 may alternatively be disposed at the side glass 320 of the vehicle of FIG. 1B.

Figure 16:
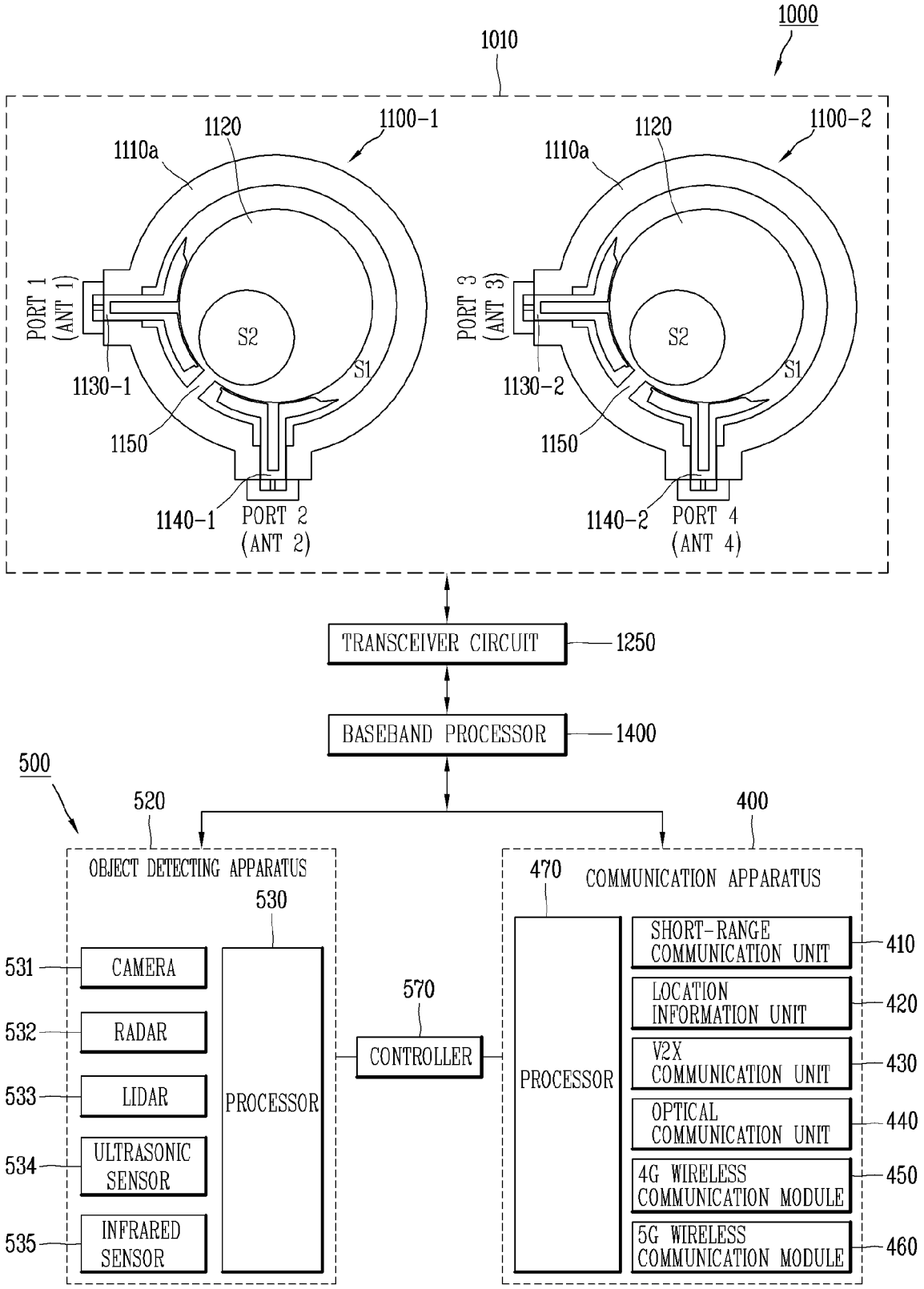
FIG. 16 is a block diagram illustrating a configuration of a vehicle to which a vehicle antenna system is mounted, according to one example.

Referring to FIGS. 1A to 15B, the antenna system 1000 for the vehicle including the antenna assembly 1100 may include a transparent pane assembly 1050 of FIG. 14A. FIG. 16 is a block diagram illustrating a configuration of a vehicle on which a vehicle antenna system is mounted, according to an example.

Referring to FIGS. 1A to 16, the vehicle 500 may include the vehicle antenna system 1000. Referring to FIGS. 1A, 1B, and 15, the vehicle 500 may include a conductive vehicle body operating as an electrical ground.

Referring to FIGS. 1A to 16, the wideband antenna system 1000 may be mounted on a vehicle. The antenna system may perform short-range communication, wireless communication, V2X communication, and the like by itself or through the communication apparatus 400. To this end, the baseband processor 1400 may be configured to receive signals from or transmit signals to adjacent vehicles, RSUs, and base stations through the antenna system 1000.

Alternatively, the baseband processor 1400 may be configured to receive signals from or transmit signals to adjacent vehicles, RSUs, and base stations through the communication apparatus 400. Here, the information related to adjacent objects may be acquired through the object detecting apparatus such as the camera 531, the radar 532, the Lidar 533, and the sensors 534 and 535 of the vehicle 300. Alternatively, the baseband processor 1400 may be configured to receive signals from or transmit signals to adjacent vehicles, RSUs, and base stations through the communication apparatus 400 and the antenna system 1000.

The antenna system 1000 may include the antenna assembly 1100 disposed at the transparent pane assembly 1050. Referring to FIG. 14A, the antenna assembly 1100 may include the dielectric substrate 1010 and the metal mesh layer 1020, but may not be limited thereto.

The antenna system 1000 may include glass 1001, a dielectric substrate 1010, and a first patch 1110, 1110*a*, 1110*c* and a second patch 1120, 1120*b*, 1120*c* disposed on a metal mesh layer 1020. The antenna system 1000 may further include a first feeding line 1130, a second feeding line 1140, and a connection line 1150.

The glass 1001 may constitute a window of the vehicle. The glass 1001 may be attached to the dielectric substrate 1010 made of the transparent film material through the OCA layer 1032. The dielectric substrate 1010 may be attached to the glass 1001 and configured to form conductive patterns in the form of the mesh grid.

The antenna assembly 1100 implemented on the dielectric substrate 1010 and the metal mesh layer 1020 may implement an antenna pattern 1100P including a plurality of conductive patterns. The antenna pattern 1100P may include the first patch 1110, 1110*a*, 1110*c* and the second patch 1120, 1120*b*, 1120*c*. The antenna pattern 1100P may further include the first feeding line 1130 and the second feeding line 1140.

The first patch 1110, 1110*a*, 1110*c* may be configured such that the first slot S1, S1*b*, S1*c* is formed at the inner region of the first conductive pattern on the dielectric substrate 1010. The first patch 1110, 1110*a*, 1110*b*, 1110*c* may radiate a signal in a first band through the first conductive pattern. The second patch 1120, 1120*b*, 1120*c* may be configured such that the second slot S2 is formed at the inner region of the second conductive pattern on the dielectric substrate 1010. In this regard, the second conductive pattern of the second patch 1120, 1120*b*, 1120*c* may be disposed at the inner region of the first slot S1, S1*b*, S1*c*. The second patch 1120, 1120*b*, 1120*c* may radiate a signal in a second band and a third band through the second conductive pattern.

The first conductive pattern of the first patch 1110, 1110*a*, 1110*c* and the second conductive pattern of the first patch 1110, 1110*a*, 1110*c* may be implemented as the metal mesh grid 1020*a* of FIG. 5 and (b) of FIG. 14. Accordingly, the first patch 1110, 1110*a*, 1110*c* and the second patch 1120, 1120*b*, 1120*c* may constitute a transparent antenna element.

The first feeding line 1130 may be disposed at the first region SR1 of the first slot S1, S1*b*, S1*c* between the inside of the first patch 1110, 1110*a*, 1110*c* and the outside of the second patch 1120, 1120*b*, 1120*c*. The second feeding line 1140 may be disposed at the second region SR2 of the first slot S1, S1*b*, S1*c* between the inside of the first patch 1110, 1110*a*, 1110*c* and the outside of the second patch 1120, 1120*b*, 1120*c*. The second region SR2 at which the second feeding line 1140 is disposed may be a region corresponding to a position where it is orthogonal to the first region SR1 at which the first feeding line 1130 is disposed.

In some examples, the first feeding line 1130 and the second feeding line 1140 may have the first CPW feeding structure and the second CPW feeding structure in which the ground patterns 1131*g* and 1141*g* are disposed at both sides of the signal lines 1131 and 1141, respectively. Partial portions of the first CPW feeding structure 1130 and the second CPW feeding structure 1140 may be implemented in a transparent area 38 of the vehicle window, and the remaining regions may be implemented in a non-transparent region 36 of the vehicle window. The antenna system 1100 may operate as the first antenna 1100*a*, ANT1 and the second antenna 1100*b*, ANT2 by the first feeding line 1130 and the second feeding line 1140. Accordingly, one physical antenna element can functionally operate as two antennas having different polarizations.

In some examples, the transparent antenna implemented as the wideband dual-polarized antenna may include a plurality of antenna elements. As illustrated in FIG. 16, the transparent antenna may include a first antenna element 1100-1 and a second antenna element 1100-2 that are spaced apart from each other by a predetermined distance.

The first antenna element 1100-1 may operate as a first antenna ANT1 having a first polarization by a first radio signal applied from the first feeding line 1130 and a second antenna ANT2 having a second polarization by a second radio signal applied from the second feeding line 1140. The first polarization and the second polarization may be formed at different angles. The second antenna element 1100-2 may operate as a third antenna ANT3 having the first polarization by the first radio signal applied from a third feeding line 1130-2 and a fourth antenna ANT4 having the second polarization by the second radio signal applied from a fourth feeding line 1140-2. The first polarization and the second polarization may be formed at different angles.

The antenna system 1000 for the vehicle may include a transceiver circuit 1250 and a processor 1400. The transceiver circuit 1250 may be operably coupled to the first antenna 1100*a*, ANT1 through the first feeding line 1130 and operably coupled to the second antenna 1100*a*, ANT2 through the second feeding line 1140. The transceiver circuit 1250 may be operably coupled to the first antenna element 1110-1 and the second antenna element 1110-2.

The processor 1400 may be operably coupled to the transceiver circuit 1250. The processor 1400 may apply a first radio signal and a second radio signal of the same band to the first antenna ANT1 and the second antenna ANT2 and control the transceiver circuit 1250 to perform MIMO through the first antenna ANT1 and the second antenna ANT2. Accordingly, the processor 1400 can control the transceiver circuit 1250 to perform 2×2 MIMO. In some examples, the processor 1400 may control the transceiver circuit 1250 to perform 4×4 MIMO through the first antenna element 1100-1 and the second antenna element 1100-2.

In some examples, Carrier Aggregation (CA) operation and/or Dual Connectivity (DC) operation may be carried out using the wideband dual-polarized antenna. In this regard, the processor 1400 may control the transceiver circuit 1250 to apply a first radio signal and a second radio signal of different bands to the first antenna ANT1 and the second antenna ANT2.

To this end, different RF chains may be connected to different ports of one antenna element. Accordingly, a first RF chain of the transceiver circuit 1250 may apply a first signal of a first band to the third feeding line 1130. On the other hand, a second RF chain of the transceiver circuit 1250 may apply a second signal of a second band to the fourth feeding line 1140. Accordingly, the CA operation and/or the DC operation can be carried out by combining (the signals of) the different bands using the single antenna element.

The foregoing description has been given of a wideband antenna assembly disposed in a vehicle and an antenna system for a vehicle having the same. Hereinafter, technical effects of the wideband antenna assembly disposed in the vehicle and the antenna system for the vehicle having the same will be described.

In some implementations, an antenna made of a transparent material that operates in a wideband range capable of providing LTE and 5G communication services can be provided by forming a first slot inside a first patch and a second slot in a second patch.

In some implementations, a transparent antenna made of a transparent material that can operate in a wideband range can be provided by combining a patch antenna structure of various shapes such as a square patch, a polygonal patch, or a circular patch with slots of various shapes.

In some implementations, an antenna structure of a transparent material, which can obtain improved antenna efficiency and transparency while operating in a wideband range by implementing conductive patterns in a metal mesh structure and defining a dummy pattern even at a dielectric region, can be provided.

In some implementations, a structure, in which an antenna structure made of a transparent material with improved antenna efficiency while operating in a wideband range can be disposed at various positions, such as an upper, lower, or side region of a front window of a vehicle, can be provided.

In some implementations, communication performance can be improved by arranging a plurality of transparent antennas on a display of an electronic device or glass of a vehicle.

Further scope of applicability of the present disclosure will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

In relation to the aforementioned disclosure, design and operations of a transparent antenna operating in a Wi-Fi band and a 5G Sub6 band and an electronic device controlling the same can be implemented as computer-readable codes in a program-recorded medium. The computer-readable media includes all types of recording devices in which data readable by a computer system can be stored. Examples of such computer-readable media may include hard disk drive (HDD), solid state disk (SSD), silicon disk drive (SDD), ROM, RAM, CD-ROM, magnetic tape, floppy disk, optical data storage element and the like. Also, the computer-readable medium may also be implemented as a format of carrier wave (e.g., transmission via an Internet). The computer may include the controller of the terminal. Therefore, the detailed description should not be limitedly construed in all of the aspects, and should be understood to be illustrative. Therefore, all changes and modifications that fall within the metes and bounds of the claims, or equivalents of such metes and bounds are therefore intended to be embraced by the appended claims.

The invention claimed is:

1. An antenna assembly comprising:

a dielectric substrate;

a first patch having a first slot formed at an inner region of a first conductive pattern disposed on the dielectric substrate and configured to radiate a signal in a first band through the first conductive pattern;

a second patch having a second slot formed at an inner region of a second conductive pattern disposed at an inner region of the first slot and configured to radiate a signal in a second band and a third band through the second conductive pattern;

a first feeding line disposed at a first region of the first slot between an inside of the first patch and an outside of the second patch;

a second feeding line disposed at a second region of the first slot between the inside of the first patch and the outside of the second patch, the second region corresponding to a position where the second feeding line is orthogonal to the first feeding line; and a connection line configured to connect the first patch and the second patch between the first feeding line and the second feeding line.

2. The antenna assembly of claim 1, wherein the first feeding line and the second feeding line configure a first Coplanar Wavelength (CPW) feeding structure and a second CPW feeding structure in which ground patterns are disposed at both sides of a signal line, wherein the signal line comprises therein a first signal line and a second signal line spaced apart from each other by a dielectric region, and wherein the first signal line and the second signal line extend along the inside of the first patch and the outside of the second patch.

3. The antenna assembly of claim 2, wherein the first patch is integrally formed with the ground patterns of the first CPW feeding structure and the second CPW feeding structure, and wherein the second patch is connected to the first patch by the connection line to be integrally formed with the ground patterns of the first CPW feeding structure and the second CPW feeding structure.

4. The antenna assembly of claim 1, wherein the second slot formed inside the second patch is a circular slot, and wherein the circular slot is offset from a center of the second patch to be disposed adjacent to the connection line.

5. The antenna assembly of claim 4, wherein the first patch is formed in a square shape, the second patch is formed in a circular shape, and the first slot and the second slot are formed in a circular shape.

6. The antenna assembly of claim 4, wherein the first patch is formed in a circular shape, the second patch is formed in a circular shape, and the first slot and the second slot are formed in a circular shape.

7. The antenna assembly of claim 4, wherein the first patch is formed in a square shape, the second patch is formed in a square shape, the first slot is formed in a square shape, and the second slot is formed in a circular shape.

8. The antenna assembly of claim 4, wherein the first patch is formed in a polygonal shape, the second patch is formed in a polygonal shape, the first slot is formed in a polygonal shape, and the second slot is formed in a circular shape.

9. The antenna assembly of claim 5, wherein radiation is carried out in the second band through the patch having the square shape disposed in the first slot inside the patch having the square shape, wherein radiation is carried out in the third band through the first slot between the patch having the square shape and the patch having the circular shape, and wherein the second band is a band higher than the first band and the third band is a band higher than the second band.

10. The antenna assembly of claim 2, wherein the first feeding line comprises:

first conductive patterns disposed at both sides of the dielectric region; and first coupling lines extending from end portions of the first conductive patterns to both sides along the first slot to couple a first signal to the first patch or the second patch, and wherein an end portion of one of the first coupling lines is spaced apart from the connection line by a predetermined distance.

11. The antenna assembly of claim 10, wherein the second feeding line comprises:

second conductive patterns disposed at both sides of the dielectric region; and second coupling lines extending from end portions of the second conductive patterns to both sides along the first slot having the circular shape to couple a second signal to the first patch or the second patch, and wherein an end portion of one of the second coupling lines is spaced apart from the connection line by a predetermined distance.

12. The antenna assembly of claim 11, wherein the first coupling lines comprise a third signal line disposed adjacent to the connection line and a fourth signal line disposed away from the connection line, and wherein the second coupling lines comprise a third signal line disposed adjacent to the connection line and a fourth signal line disposed away from the connection line.

13. The antenna assembly of claim 12, wherein the antenna assembly operates as a first antenna and a second antenna in the third band by the first slot between the fourth signal line of the first coupling lines and the fourth signal line of the second coupling lines.

14. The antenna assembly of claim 13, wherein first ground patterns are disposed adjacent to the first conductive patterns, and second ground patterns are disposed adjacent to the second conductive patterns, and wherein gaps between the first ground patterns and the first conductive patterns increases from a first gap to a second gap as being adjacent to the first slot having a circular shape.

15. The antenna assembly of claim 1, wherein the antenna assembly operates as a first antenna having a first polarization by a first radio signal applied from the first feeding line, wherein the antenna assembly operates as a second antenna having a second polarization orthogonal to the first polarization by a second radio signal applied from the second feeding line.

16. The antenna assembly of claim 1, wherein the first conductive pattern of the first patch and the second conductive pattern of the second patch are configured as metal mesh patterns in which a plurality of grids are electrically connected, so as to implement the antenna assembly as a transparent antenna.

17. An antenna system for a vehicle that comprises a conductive vehicle body operating as an electrical ground, the antenna system comprising:

glass constituting a window of the vehicle;

a dielectric substrate attached to the glass and having conductive patterns in a form of a mesh grid;

a first patch having a first slot formed at an inner region of a first conductive pattern on the dielectric substrate and configured to radiate a signal in a first band through the first conductive pattern;

a second patch having a second slot formed at an inner region of a second conductive pattern disposed at an inner region of the first slot and configured to radiate a signal in a second band and a third band through the second conductive pattern, the first patch and the second patch being transparent antenna elements;

a first feeding line disposed at a first region of the first slot between an inside of the first patch and an outside of the second patch;

a second feeding line disposed at a second region of the first slot between the inside of the first patch and the outside of the second patch, the second region corresponding to a position where the second feeding line is orthogonal to the first feeding line; and a connection line configured to connect the first patch and the second patch between the first feeding line and the second feeding line.

18. The antenna system of claim 17, wherein the first feeding line and the second feeding line configure a first Coplanar Wavelength (CPW) feeding structure and a second CPW feeding structure in which ground patterns are disposed at both sides of a signal line, wherein partial regions of the first CPW feeding structure and the second CPW feeding structure are implemented in a transparent region of the window of the vehicle, and remaining regions are implemented in a non-transparent region of the window of the vehicle, and wherein the antenna system operates as a first antenna and a second antenna by the first feeding line and the second feeding line.

19. The antenna system of claim 18, further comprising:

a transceiver circuit operably coupled to the first antenna through the first feeding line and operably coupled to the second antenna through the second feeding line; and a processor operably coupled to the transceiver circuit and configured to control the transceiver circuit, wherein the transparent antenna elements comprise a first antenna element and a second antenna element spaced apart from each other by a predetermined distance, wherein the first antenna element operates as a first antenna having a first polarization by a first radio signal applied from the first feeding line, and as a second antenna having a second polarization different from the first polarization by a second radio signal applied from the second feeding line, wherein the second antenna element operates as a third antenna having the first polarization by a third radio signal applied from a third feeding line, and as a fourth antenna having the second polarization by a fourth radio signal applied from a fourth feeding line, and wherein the processor is configured to control the transceiver circuit to perform 4×4 Multi-input/Multi-output (MIMO) through the first antenna element and the second antenna element.

20. The antenna system of claim 19, wherein the processor controls the transceiver circuit to apply a first radio signal and a second radio signal of different bands to the first antenna and the second antenna, to perform Carrier Aggregation (CA) or Dual Connectivity (DC) through the first antenna and the second antenna.

* * * * *